US005235733A

United States Patent [19]

Willbanks et al.

[11] Patent Number: 5,235,733

[45] Date of Patent: Aug. 17, 1993

[54] METHOD AND APPARATUS FOR PATTERNING FABRICS AND PRODUCTS

[75] Inventors: Charles E. Willbanks, Spartanburg; Charles B. Fitzgerald, Gaffney, both of S.C.

[73] Assignee: Milliken Research Corporation, Spartanburg, S.C.

[21] Appl. No.: 620,550

[22] Filed: Nov. 30, 1990

Related U.S. Application Data

[63] Continuation-in-part of Ser. No. 537,223, Jun. 13, 1990, Pat. No. 5,080,952, which is a continuation of Ser. No. 456,046, Dec. 26, 1989, abandoned, which is a continuation of Ser. No. 376,947, Jul. 7, 1989, abandoned, which is a continuation of Ser. No. 266,246, Oct. 28, 1988, abandoned, which is a continuation of Ser. No. 35,672, Apr. 7, 1987, abandoned, which is a continuation-in-part of Ser. No. 930,011, Aug. 25, 1986, abandoned, which is a continuation of Ser. No. 656,119, Sep. 28, 1984, abandoned.

[51] Int. Cl.[5] ..... D06C 23/00; D04H 18/00; B23Q 15/00

[52] U.S. Cl. ..... 28/105; 26/69 R; 226/15

[58] Field of Search ..... 26/75, 69; 68/205 R; 226/15; 28/104, 105

[56] References Cited

U.S. PATENT DOCUMENTS

| | | | |
|---|---|---|---|
| Re. 31,601 | 6/1984 | Ikeda et al. | 428/93 |
| 2,862,251 | 12/1958 | Kalwaites | 19/161 |
| 3,033,721 | 5/1962 | Kalwaites | 154/46 |
| 3,214,819 | 11/1965 | Guerin | 28/72.2 |
| 3,333,315 | 8/1967 | Dyer et al. | 28/72.2 |
| 3,403,862 | 10/1968 | Dworjanyn | 239/566 |
| 3,434,188 | 3/1969 | Summers | 28/72.2 |
| 3,485,706 | 12/1969 | Evans | 161/72 |
| 3,485,708 | 12/1969 | Ballou et al. | 161/72 |
| 3,485,709 | 12/1969 | Evans et al. | 161/109 |
| 3,486,168 | 12/1969 | Evans et al. | 161/169 |
| 3,493,462 | 2/1970 | Bunting, Jr. et al. | 161/169 |
| 3,494,821 | 2/1970 | Evans | 161/169 |
| 3,508,308 | 4/1970 | Bunting, Jr. et al. | 28/72.2 |
| 3,546,755 | 12/1970 | Lynch | 28/72.2 |
| 3,560,326 | 2/1971 | Bunting, Jr. et al. | 161/169 |
| 3,616,175 | 10/1971 | Jung | 161/164 |
| 3,620,903 | 11/1971 | Bunting, Jr. et al. | 161/169 |
| 3,688,355 | 9/1972 | Okzaki et al. | 28/1.4 |
| 3,750,237 | 8/1973 | Kalwaites | 19/161 P |
| 3,768,121 | 10/1973 | Kalwaites | 19/161 P |
| 3,769,659 | 11/1973 | Kalwaites | 19/161 P |
| 3,787,932 | 1/1974 | Kalwaites | 19/161 P |
| 3,800,364 | 4/1974 | Kalwaites | 19/161 P |
| 3,837,046 | 9/1974 | Kalwaites | 19/161 P |
| 3,873,255 | 3/1975 | Kalwaites | 425/83 |
| 4,024,612 | 5/1977 | Contractor et al. | 28/72.2 F |
| 4,069,563 | 1/1978 | Contractor et al. | 28/105 |
| 4,085,485 | 4/1978 | Brandon et al. | 28/104 |
| 4,146,663 | 3/1979 | Ikeda et al. | 428/96 |

(List continued on next page.)

FOREIGN PATENT DOCUMENTS

| | | |
|---|---|---|
| 287821 | 9/1964 | Australia . |
| 0210777 | 2/1987 | European Pat. Off. . |
| 0228197 | 7/1987 | European Pat. Off. . |
| WO89/09850 | 10/1989 | PCT Int'l Appl. . |
| WO89/10441 | 11/1989 | PCT Int'l Appl. . |
| 952819 | 3/1964 | United Kingdom . |
| 1063252 | 3/1967 | United Kingdom . |
| 1101899 | 1/1968 | United Kingdom . |
| 1380071 | 1/1975 | United Kingdom . |

OTHER PUBLICATIONS

Kenneth R. Randall, "Hydroentanglement Technology For Wet-Laid Applications," *Nonwovens World*, Mar. 1989, pp. 28-31.

*Primary Examiner*—Clifford D. Crowder
*Assistant Examiner*—John J. Calvert
*Attorney, Agent, or Firm*—Kevin M. Kercher; H. William Petry

[57] ABSTRACT

A novel apparatus and method of patterning a textile fabric comprising fluid jets directed at an angle from the perpendicular line of intersection between the fluid jets and the fabric which eliminates stress lines, troughs and valleys in the fabric by placing a lateral force on the fabric.

25 Claims, 24 Drawing Sheets

U.S. PATENT DOCUMENTS

| | | | |
|---|---|---|---|
| 4,228,123 | 10/1980 | Marshall | 264/557 |
| 4,322,026 | 3/1982 | Young, Jr. | 26/75 X |
| 4,329,763 | 5/1982 | Alexander et al. | 28/104 |
| 4,368,227 | 1/1983 | Setsuie et al. | 428/91 |
| 4,410,579 | 10/1983 | Johns | 428/131 |
| 4,422,308 | 12/1983 | Pfeiffer et al. | 68/205 R X |
| 4,426,420 | 1/1984 | Likhyani | 428/224 |
| 4,442,161 | 4/1984 | Kirayoglu et al. | 428/219 |
| 4,453,298 | 6/1984 | Nabulon et al. | 28/255 |
| 4,582,666 | 4/1986 | Kenworthy et al. | 264/557 |
| 4,591,513 | 5/1986 | Suzuki et al. | 427/200 |
| 4,665,597 | 5/1987 | Suzuki et al. | 28/104 |
| 4,695,422 | 9/1987 | Curro et al. | 264/504 |
| 4,718,152 | 1/1988 | Suzuki et al. | 28/104 |
| 4,743,483 | 5/1988 | Shimizu et al. | 428/89 |
| 4,767,584 | 8/1988 | Siler | 68/205 R X |
| 4,995,151 | 2/1991 | Siegel et al. | 26/69 R |

METHOD AND APPARATUS FOR PATTERNING FABRICS AND PRODUCTS

CROSS-REFERENCE TO RELATED APPLICATION

This application is a continuation-in-part of U.S. patent application Ser. No. 07/537,223, filed Jun. 13, 1990, now issued as U.S. Pat. No. 5,080,952; which in turn is a continuation of U.S. patent application Ser. No. 07/456,046, filed Dec. 26, 1989, now abandoned, which in turn is a continuation of U.S. patent application Ser. No. 07/376,947, filed Jul. 7, 1989, now abandoned; which in turn is a continuation of U.S. paten application Ser. No. 07/266,246, filed Oct. 28, 1988, now abandoned; which in turns is a continuation of U.S. patent application Ser. No. 07/035,672, filed Apr. 7, 1987, now abandoned; which in turn is a continuation-in-part of U.S. patent application Ser. No. 06/930,011, filed Aug. 25, 1986, now abandoned; which in turn is a continuation of U.S. patent application Ser. No. 06/656,119, filed Sep. 28, 1984, now abandoned.

This invention relates to a novel textile product having raised surface fibers, and to a method for generating such product. In particular, this invention is directed to the fabrication of textile fabrics having a napped surface of uniform height in which the raised yarns have been raised from yarns originally comprising a flat substrate, or from yarns which have been previously partially raised, as in a fabric previously napped to a low or moderate degree, and wherein the napping operation is achieved using high velocity fluid streams, with no need for subsequent shearing. The textile industry is constantly searching for commercially practical methods by which textile fabrics, especially fabrics suitable for apparel or decorative interior use, may be patterned, textured, or otherwise made more attractive. Of particular interest are economical methods by which (1) standard fabrics may be made to look and/or feel like more attractive and expensive fabrics, or (2) standard fabrics may be transformed into unusual fabrics having attractive or desirable characteristics not available in any other fabric.

Of particular interest are methods in which the texture, structure, or surface appearance of a fabric are modified, and in which (1) a variety of different pattern or texture effects may be generated, depending upon process conditions and the nature of the fabric being patterned;

(2) fabrics having truly novel characteristics may be generated from fabrics of conventional construction;

(3) the desired effects or characteristics may be imparted to the fabric in a highly controlled, reproducible manner yet may be modified or changed quickly, with a minimum of lost production time or expense;

(4) the speed and cost of generating such effects or characteristics makes the method commercially economical; and (5) the generation of such effects may be controlled electronically to eliminate such conventional concerns as repeat length, complexity of pattern, minimum economical run length, and fabric waste between pattern changes.

Pile fabrics of various kinds are frequently considered among the most luxurious or desirable types of fabrics because of their combination of soft hand and interesting texture and appearance. Fabrics having a pile surface can be classified into two categories — those in which the pile face has been generated as an integral part of the fabric construction (e.g., velvet fabrics in which the fabric is constructed as a "sandwich" fabric which is woven or warp knitted with interlacing yarn connecting opposing fabric faces, which yarn is then cut midway between the faces to form two fabrics with opposing pile faces), and those in which the pile is raised on an otherwise flat fabric face by mechanical means.

Napping operations are directed to generating fabrics of the latter type, and are common to the textile industry for the purpose of raising a layer of down-like fibers on the face of otherwise flat surfaced textile fabrics. This down-like layer, by acting as a resilient network of air-trapping fibers, causes the resulting fabric to provide a great many desirable qualities, such as greater warmth to the wearer, increased softness to the touch, and greater "cover" (e.g., increased relative light opacity). Most commonly, such napping operations are performed using rapidly rotating drums covered with protruding steel wires. The fabric to be napped is placed against a backing member, and the face of the fabric is brought into moving contact with the moving steel wires. The wire ends engage and pull yarns from the body of the fabric; the degree to which the yarn is pulled depends upon several factors; usually, the yarn is pulled until the engaged yarn breaks or slips off the wire end because of changing geometry. Frequently, the ends of the wires contacting the fabric have been shaped or bent in ways designed to achieve a particular desirable effect or particular degree of fiber raising.

An inevitable consequence of such wire napping operations is the non-uniformity of the height to which the fibers are pulled, teased, or extended by the action of the wire ends. This non-uniformity of height is frequently considered undesirable, and necessitates a shearing operation to be performed in addition to the napping operation. By shearing the napped surface, the previously napped surface may be given a surface which appears uniform in height and degree of treatment, but at the expense of removing, via the shearing operation, all napped fibers which extend above the shear height. This, of course, cuts many fibers at one or more places along their length, making them shorter, on the average, than other fibers comprising the constituent yarns, and wastes fibers which might otherwise contribute to the weight, cover, and insulating properties of the fabric. It also generates a greater number of cut ends comprising the pile surface than would otherwise be present in the napped but unsheared product, due to the cutting of fiber and yarn loops raised in the napping operation; this increase in the number of cut ends, which frequently have an irregular or uneven profile, may reduce the crush resistance of the pile as well as promote fraying of the yarn ends, and is believed to degrade the hand of the fabric and increase the tendency of the fabric to retain lint.

Additionally, it is well known that in such shearing operations using moving wire-covered drums, the wire ends tend to act predominately upon the yarns oriented in the fill direction, which are oriented parallel to the axis of the wire drums and perpendicular to the path of movement of the wire ends across the face of the fabric. This is believed to be due to the fact that the wire ends encounter these yarns in a "broadside" orientation, but encounter the warp direction yarns in an "on-axis" or parallel orientation. Because of this, the yarns oriented in the fill direction in a conventionally napped fabric tend to be pulled from the fabric, and, additionally, are frequently damaged or broken in the process. Both phenomena contribute to a significant loss of strength in the fill yarn direction in such fabrics. To compensate for this strength loss, it is commonly necessary to increase the size or fiber content of the fill direction yarns, so the finished fabric will exhibit acceptable strength in the fill direction. In the case of a woven fabric, this generally results in a reduction in weaving efficiency, because the new heavier weight fill direction yarns are the yarns which must be repeatedly transported across the relatively stationary warp yarns.

A major problem with the current method of directing fluid jets against the fabric in a straight perpendicular line is that wrinkles, puckers, troughs, stress lines and valleys form in the fabric which provide significant quality problems, especially at higher fluid pressures.

The invention disclosed herein comprises a napped fabric having substantially uniform height and cover which is generated in a single process, without the necessity of a separate shearing operation, and without the degree of weakening of the fabric strength, for example, in either the warp or the fill direction, normally associated with conventional napping techniques. Therefore, for a given degree of pile raising, the invention disclosed herein comprises a fabric which exhibits substantially greater strength than may be achieved using conventional napping and shearing operations. Novel products are generated by a textile treatment process wherein one or more jets of high velocity liquid, for example, water, are directed onto a flat fabric surface which is supported by a solid, non-contoured backing member. The liquid jets, by interacting with the fabric and the backing member, raise a fine dense pile of remarkable uniformity on the fabric surface opposite the jets. The resulting pile surface is believed to exhibit a greater pile density and uniformity, including uniformity of observed pile height and uniformity of maximum individual pile fiber height, than similar fabrics which have been napped only using conventional methods, and are believed to result in a product having greater overall specific fabric weight (i.e., greater weight per unit area of fabric), fewer fiber cut ends, and, in the case of woven fabrics, greater fill yarn strength than similar starting fabrics which have been conventionally napped and sheared to achieve the same degree of uniform pile height. As will be further discussed below, the fiber raising action of the liquid jets appears to operate principally upon the warp yarns, with substantially fewer non-warp yarn fibers being raised. The warp yarns utilized in this invention may be part of a woven fabric, a knit fabric, or other construction having yarns generally extending in a warp direction. To minimize fabric puckering, it is preferred that the warp direction yarns be of the spun yarn variety.

It is believed the liquid jets, upon initial impact, pass through the fabric and collide with the surface of the backing member, whereupon the liquid spreads over the surface of the backing member and tends to "float" the fabric on a thin film of liquid of substantially uniform thickness. Incoming jets can entrain, without breaking or cutting, fabric yarn fibers as the jets pass through the fabric, with the liquid film providing a medium of uniform thickness through which the yarn fibers may be pulled or raised, up to the boundary imposed by the surface of the backing member. This boundary appears to place a limit on maximum fiber extension or maximum pile height, and results in a pile surface having a highly uniform observed pile height which needs no shearing.

As an additional benefit, it has been determined that a napping action also occurs on the side of the fabric facing the jets, but to a substantially lesser degree. It is theorized that the extremely high velocity of the fluid which penetrates the fabric and strikes the backing member can ricochet or rebound after striking the backing member and can re-penetrate the fabric in an outward direction, entraining yarn fibers and causing modest fiber raising on the side of the fabric facing the jets.

A significant improvement in this process is to direct the fluid jets at an angle to put lateral stress on the fabric eliminating wrinkles, puckers, troughs, stress lines and valleys while leaving the width of the fabric the same. With this improvement, the fluid can be at a higher pressure which results in more nap and better surface uniformity.

Further advantages and features of the invention will become apparent in the discussion hereinbelow, when read in conjunction with the accompanying Figures, in which.

Several approaches contemplated and used by the inventor to generate the products disclosed herein are depicted in FIGS. 1 through 10, and are discussed in more detail below. Alternative approaches, conceived by others and useful for generating the products disclosed herein, are depicted in FIGS. 11 through 17, and are discussed in more detail further below.

Figure 1:
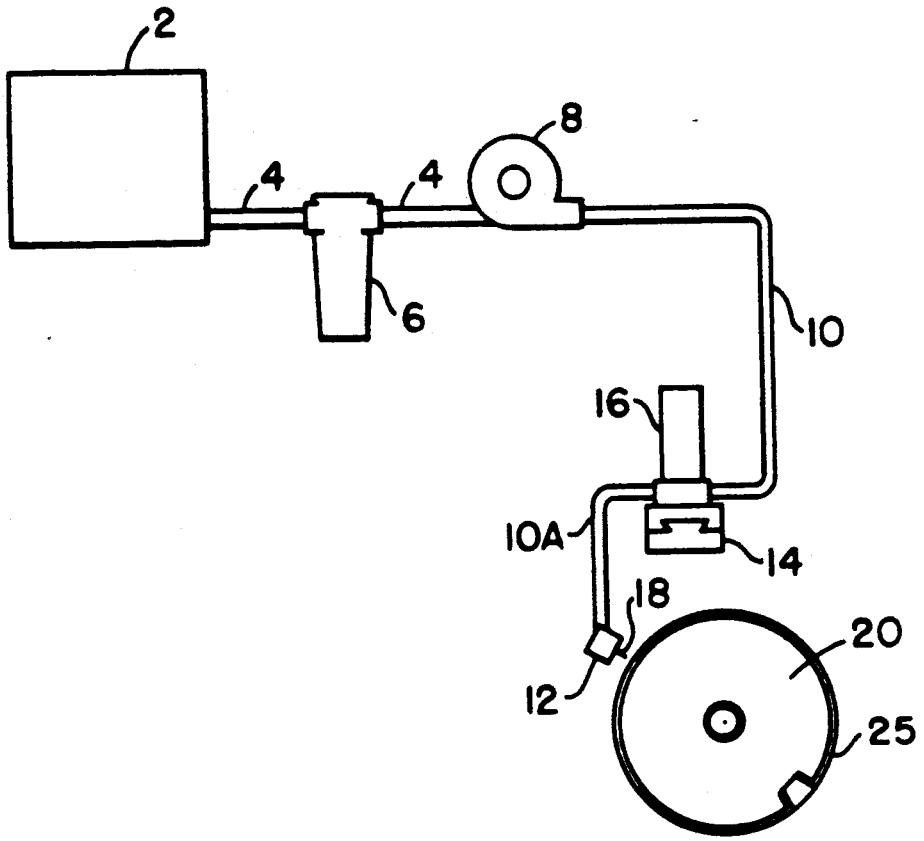
FIG. 1 is a schematicized side view of an apparatus for generating the fabric of the instant invention wherein a pre-cut section of fabric is patterned by a traversing liquid jet under solenoid or pneumatic valve control.
Figure 2:
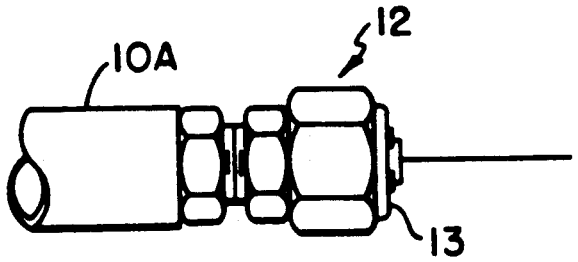
FIG. 2 is a side view of one embodiment of an orifice assembly for a single jet.

FIG. 1 schematically depicts an apparatus which may be used to generate the products of this invention. For purposes of discussion hereinbelow, water will be assumed as the working fluid of choice, although other fluids may be substituted therefore. Pump 8 is a pump capable of pumping the water or other desired working fluid at the desired rate and pressure. If a single liquid stream is used, the pump should be capable of delivering a single stream having a minimum cross-section dimension within the range of about 0.003 inch to about 0.03 inch, at dynamic pressures ranging from about 75 p.s.i.g. to about 3000 p.s.i.g. (i.e., water stream velocities ranging from about 200 f.p.s. to about 667 f.p.s.), although stream sizes and stream pressures (or velocities)

outside this range may prove advantageous under certain circumstances. Generally speaking, streams having diameters lying within the range of about 0.007 to about 0.03 inch are preferred. Such streams have a diameter which is generally less than twice as large as the spacing between adjacent yarns in most textile fabrics. Dynamic pressures in excess of about 1,000 p.s.i.g. are also generally preferred. Use of simultaneous multiple streams, as described hereinafter, will, of course, require increased pump capacity. As indicated in FIG. 1, pump 8 is connected to a source 2 of the desired working fluid, e.g., water, via conduit 4 and filter assembly 6. Filter assembly 6 is intended to remove undesirable particulate matter from the working liquid which could clog the various orifice assemblies discussed in more detail below. The high pressure output of pump 8 is fed, via high pressure conduits 10 and 10A, to high velocity fluid orifice assembly 12. Orifice assembly 12, in simple form, may be merely a suitable termination of conduit 10A having a single orifice of the size which will generate a fluid stream of the desired cross-sectional shape and area, and which will operate safely at the desired pressure, as depicted in FIG. 2. Conduits 10 and 10A may be any suitable conduit capable of safely accommodating the desired fluid pressures and flow rates, and having sufficient flexibility or rigidity to permit orifice assembly 12 to be positioned as desired with respect to the substrate to be treated.

Situated in close proximity to orifice assembly 12 is roll 20, over which the textile fabric to be treated is placed. Generally, roll 20 has a solid, smooth, inflexible surface (e.g., polished aluminum or stainless steel); a roll having a specially treated or formed surface may be useful in achieving certain special effects on selected substrates. It has been found, for example, that use of a contoured roll surface may result in patterning effects corresponding to the roll surface contours on the substrate.

Figure 3:
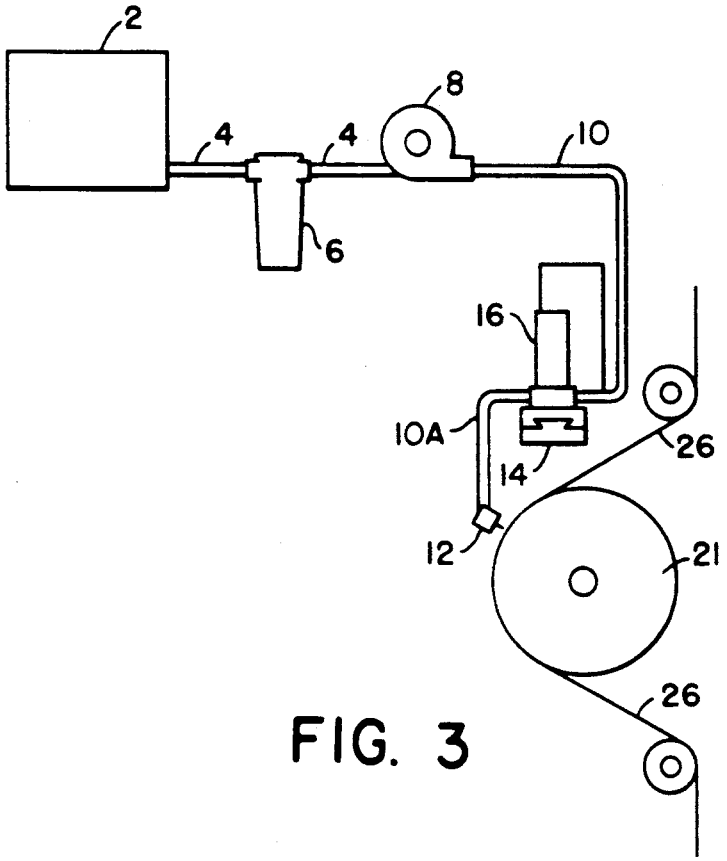
FIG. 3 is a schematicized side view of an apparatus for generating the fabric of the instant invention wherein a continuous web of fabric is patterned by a traversing liquid jet under solenoid or pneumatic valve control.

Associated with roll 20 is textile fabric 25, which may be in the form of a fabric section which is wrapped about the circumference of roll 20 and securely attached at both ends, as depicted in FIG. 1, or which may be in the form of a continuously moving web which is positioned against a portion of roll 20, depicted in, e.g., FIG. 3 at 26.

In order to generate a pattern on textile fabric 25, contact between the fabric and the high velocity stream of fluid emanating from orifice assembly 12 must be established and interrupted in a way which corresponds to the desired length and lateral spacing of the stripes comprising the pattern. Where a solid area is to be treated, the fluid streams may be made to contact the fabric in closely adjacent or overlapping stripes.

FIG. 1 shows a diagrammatic side view of a texturing and patterning system in which an orifice assembly 12, which produces a single high velocity fluid jet 18, is associated with a traversing table 14. Table 14 permits orifice assembly 12 to be moved, in a precisely controlled and reproducible manner, parallel to the axis of roll 20, around which is affixed a section of fabric 25 in the form of a sleeve or a short section of fabric, which is securely fastened at both ends about the circumference of roll 20. Orifice assembly 12 may be constructed by installing a high pressure cap 13 having a single orifice of the proper size on the end of a suitable high pressure conduit 10A, as depicted in FIG. 2. Of course, more elaborate orifice assemblies may be used as well, as will be discussed below.

Associated with conduits 10 and 10A is remotely actuated fluid valve 16, which valve is preferably installed in close proximity to orifice assembly 12 so as to minimize the length of conduit 10A between valve 16 and orifice assembly 12 and the attendant "water hammer" effect. Valve 16 may be actuated electrically, pneumatically, or by other means. In one embodiment, valve 16 comprises an electrical solenoid valve of the type marketed by the Skinner Valve Company, a division of Honeywell, Inc., of Minneapolis, Minn., as Model V52H. This valve may be installed upstream of orifice assembly 12, in a conventional manner such as to control the flow of fluid in conduit 10A.

In operation, a working fluid, e.g., water, is pumped by pump 8 from fluid source 2, through filter means 6, to valve 16. If the portion of fabric 25 directly opposite orifice assembly 12 is to be treated, valve 16 is made to open, e.g., via an electrical or pneumatic command signal, and high pressure water is allowed to pass via conduit 10A to orifice assembly 12, where a thin, high velocity water jet 18 is formed and directed onto the fabric 25. When the desired pattern requires that jet 18 not impact the fabric 25, an appropriate electrically or pneumatically transmitted instruction causes valve 16 to close. Positioning the desired areas of fabric surface under the jet 18 is achieved by proper coordination of rotation of roll 20 and translation of traversing table 14, which preferably may be accomplished by computer control, in conjunction with a rotation sensor mounted in association with roll 20.

Figure 4:
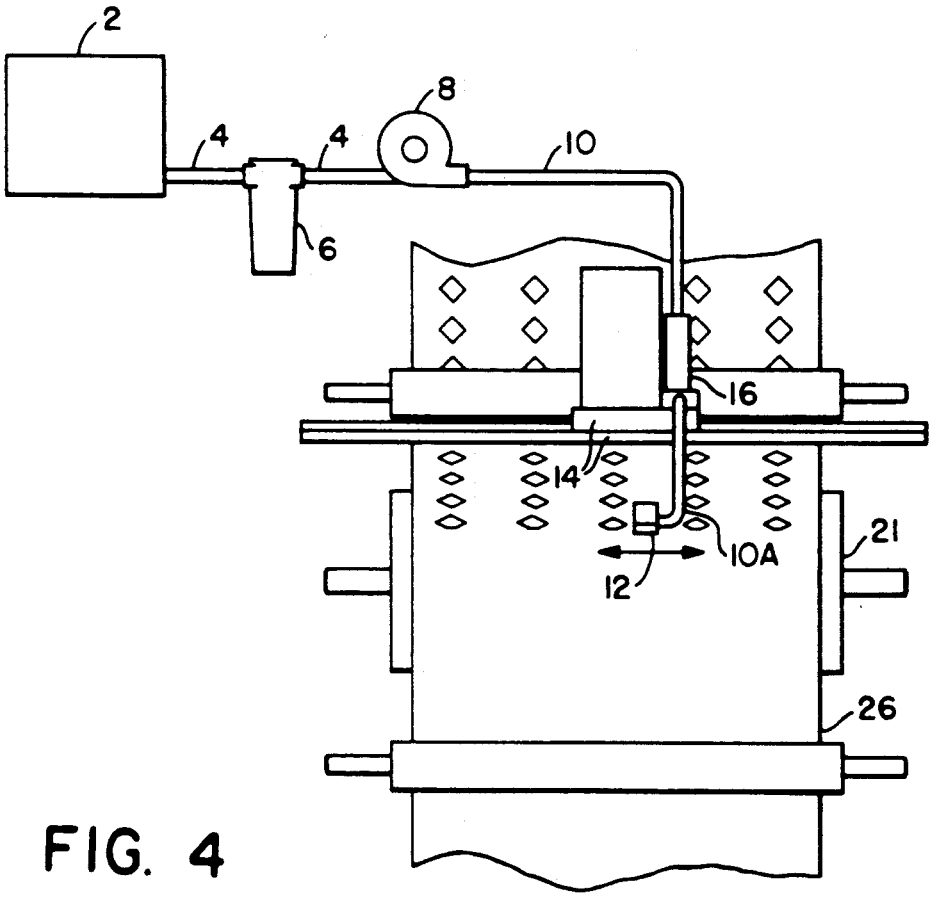
FIG. 4 is a schematicized plan view of the apparatus of FIG. 3.

Assuming that appropriate indicating means are used to specify, via a digital signal, the exact rotational position of roll 20 and lateral position of traversing table 14, a computer may be used to generate on/off instructions to valve 16 in accordance with pre-programmed pattern data. It is contemplated that roll 20 may be made to rotate continuously while traversing table 14 moves relatively slowly, in incremental linear steps, along the axis of the roll, or, preferably, roll 20 may be made to move intermittently, while traversing table 14 sweeps across the fabric face for each incremental rotational movement of roll 20. If the latter technique is employed, fabric 25 may be in the form of a web 26 traveling over roll 21, as shown in FIGS. 3 and 4, which better lends itself to commercial production methods.

It should be understood that, if desired, an orifice assembly which can generate a multiple jet array may be substituted for the single jet orifice assembly 12. In most commercial applications, this will comprise a preferred embodiment, particularly if computer control is available to control the actuation of the multiple valves necessary in such system, and will be described below.

Figure 5:
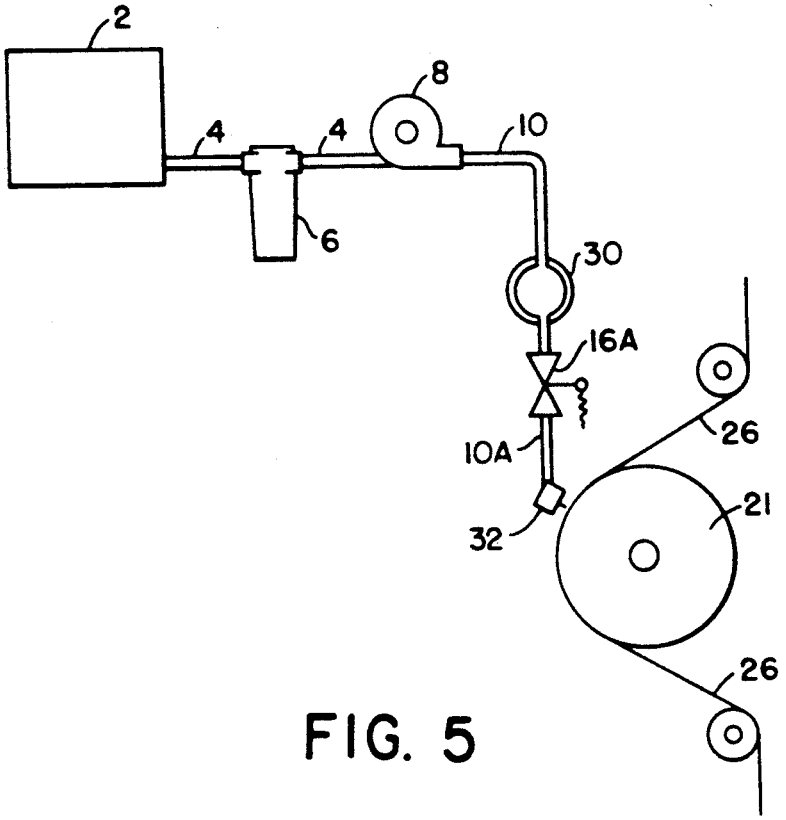
FIG. 5 is a schematicized side view of an apparatus for generating the fabric of the instant invention wherein multiple jets, under individual solenoid or pneumatic cylinder control, are used to pattern a web of fabric.
Figure 6:
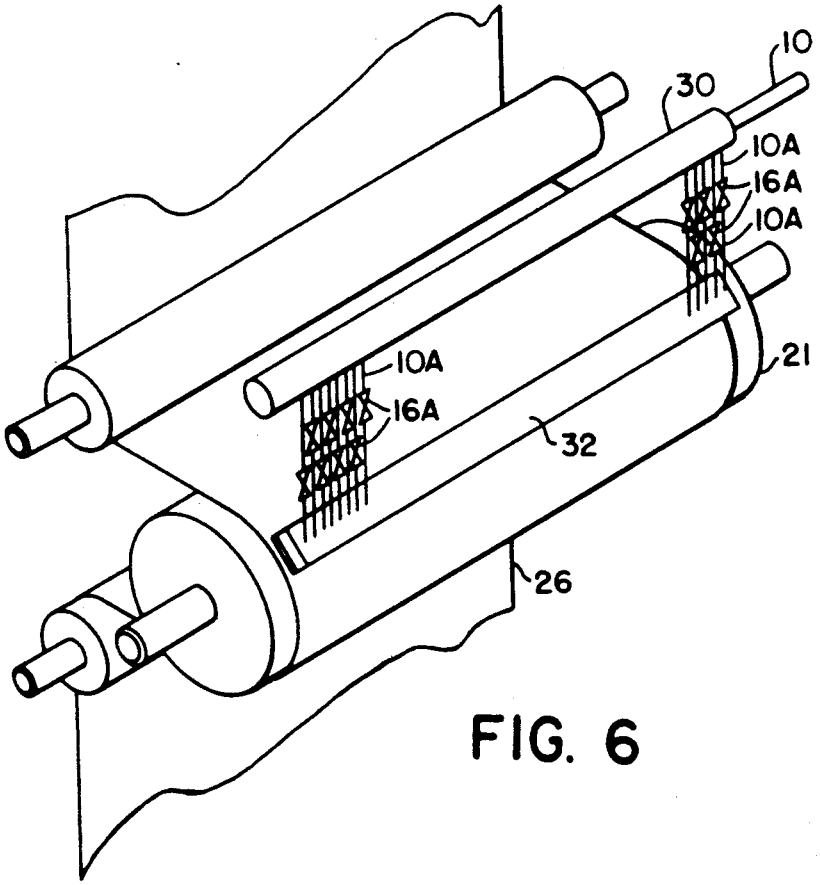
FIG. 6 is a diagrammatic perspective view of the apparatus of FIG. 5.
Figure 7:
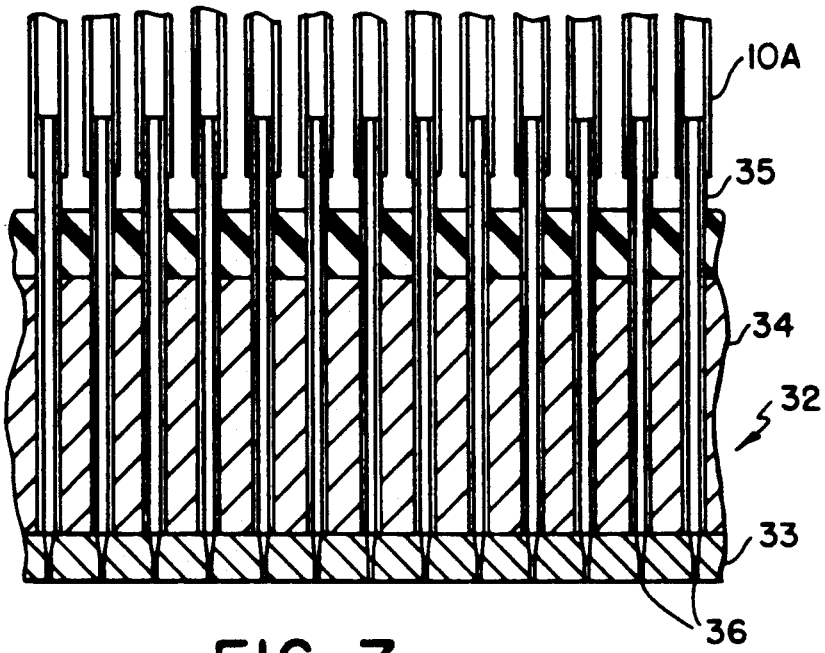
FIG. 7 is a section view of an orifice assembly suitable for use in the apparatus of FIGS. 5 and 6.

As depicted in FIGS. 5 through 7, a multiple jet array orifice assembly 32 is situated in close proximity to the surface of fabric web 26, as web 26 passes over roll 21. Array assembly 32 may be sufficiently wide to extend entirely across web 26, or may comprise a fraction of the width of web 26. In the latter case, a traversing table or other means may be used, as discussed above, to obtain full-width coverage. Associated with each orifice in array assembly 32, and situated in a corresponding conduit 10A, is a separate remotely actuatable valve, designated at 16A, which serves to interrupt or control the stream of high velocity fluid emanating from its respective orifice in array assembly 32. As before, these valves can be of any suitable kind, e.g., electrical, pneumatic, etc., and may be installed in any satisfactory conventional manner which will allow safe and positive control of the pressurized fluid. Inserted between pump 8 and the array of valves 16A is a hydraulic accumulator or ballast tank 30. By using such tank 30, pump 8 may be specified at a somewhat smaller capacity than would otherwise be the case. Peak, short term demands for high pressure liquid, as when all jets are firing for a given short period of time, may be met by the capacity stored or accumulated in tank 30. FIG. 7 depicts a section view of array assembly 32, taken perpendicular to the surface of roll 21 and bisecting the orifices in assembly 32. Orifice block 34 is drilled and fitted with tubes 35 which extend beyond block 34 and which are securely connected with respective supply conduits 10A. Orifice plate 33 is drilled with converging passages 36 which form collectively an array of jets.

Figure 8:
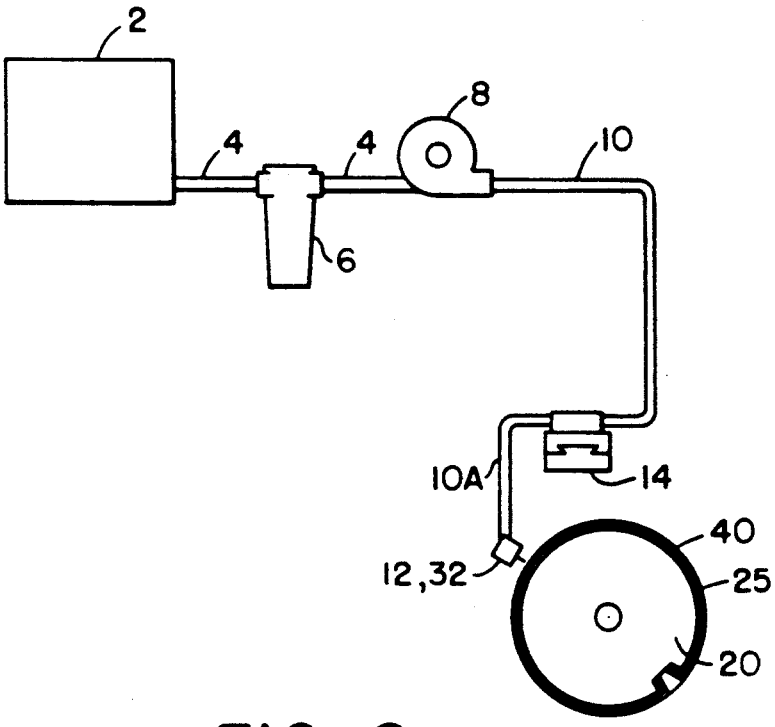
FIG. 8 is a schematicized side view of an apparatus for generating the fabric of the instant invention wherein a pre-cut section of fabric is patterned by a traversing liquid jet situated opposite a stencil which is interposed between the jet and the fabric surface.

In another embodiment of this invention, depicted in FIG. 8, a stencil is interposed between a single jet or an array of jets and the fabric 25 to interrupt the liquid stream, in place of the valves disclosed above. In the form shown in FIG. 8, a sleeve-type stencil 40, comprised of stainless steel, suitable plastic, or other suitable material which serves to mask areas of the fabric which are not to be treated, is placed in fixed relationship over the fabric segment 25 which is attached to roll 20. If desired, a traversing means 14 may be used to move the high velocity fluid jet or jets formed at assembly 12 or 32 across the face of the stencil 40 as the stencil and fabric are rotated together on roll 20. If a sufficiently wide multiple jet array is used, traversing means 14 is unnecessary. The fluid streams directly contact the fabric only where permitted by apertures in the stencil 40.

Figure 9:
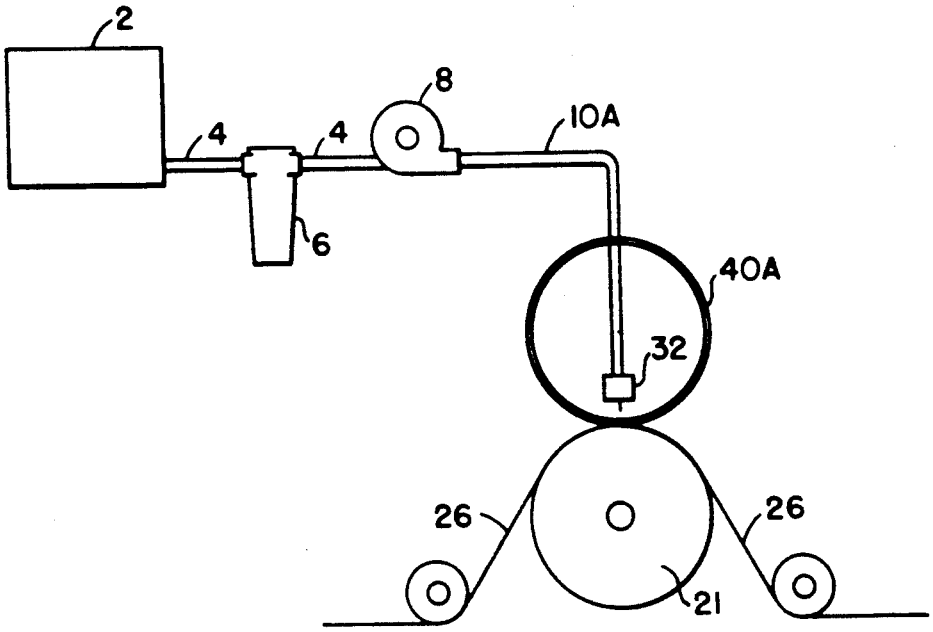
FIG. 9 is a schematicized side view of an apparatus for generating the fabric of the instant invention wherein an array of liquid jets is placed inside a stencil in the form of a cylinder, which in turn is brought into close proximity to the fabric surface.
Figure 10:
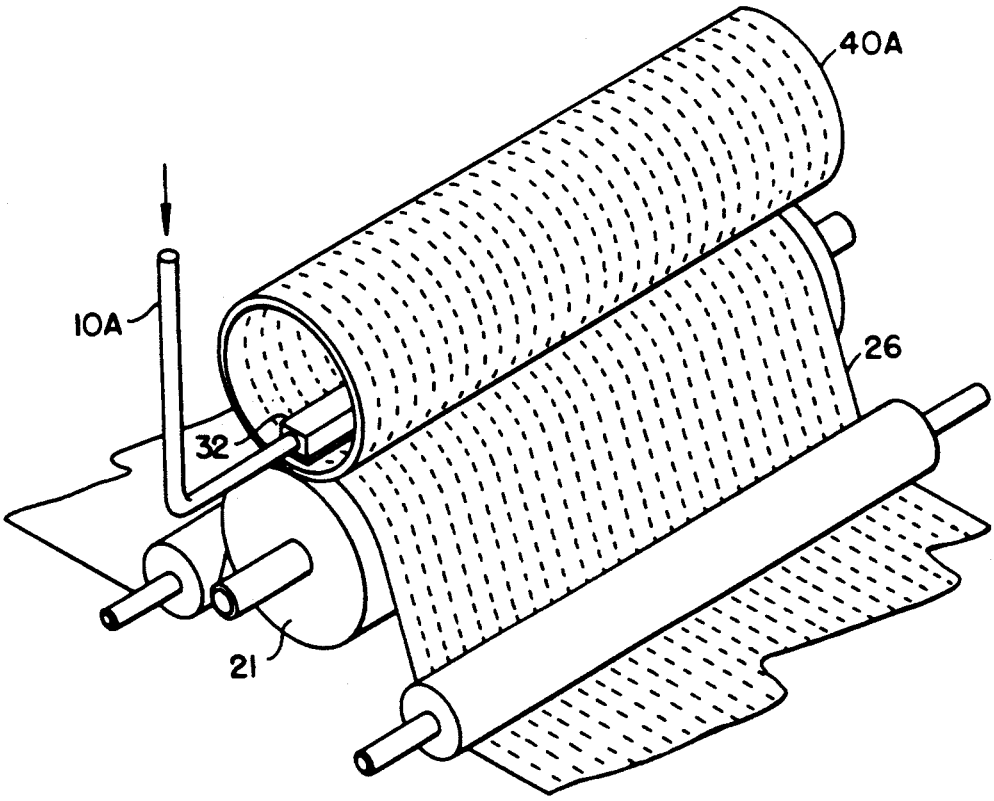
FIG. 10 is a diagrammatic perspective view of the apparatus of FIG. 9.

In an alternative and preferred stencil embodiment, the stencil is configured to allow the fabric to be patterned to be in the form of a moving web. FIGS. 9 and 10 show a configuration whereby a cylindrical stencil 40A is arranged to accommodate a multiple jet array orifice assembly such as shown at 32 within the stencil 40A. In this configuration, orifice assembly 32 preferably comprises an array of jets which extends across the entire width of stencil 40A, which in turn extends across the entire width of fabric web 26. Orifice assembly 32 is preferably located in close proximity to the inside surface of cylindrical stencil 40A; the outer surface of stencil 40A is preferably located in close proximity to, and perhaps in direct contact with, the surface of fabric web 26. Means, not shown, are provided to achieve smooth rotation of stencil 40A in synchronism with the movement of fabric web 26. This may be achieved, for example, by an appropriate gear train operating on a ring gear which is associated with one or both ends of cylindrical stencil 40A.

It is also contemplated that a single or multiple jet array may be used which is made to traverse within cylindrical stencil 40A so that the entire width of fabric web 26 may be treated. Use of such traversing jet or jet array would preferably require incremental movement of fabric web 26, as discussed above.

Certain other approaches for selectively interrupting or otherwise controlling the impact of one or more streams of high velocity liquid on the fabric surface in response to pattern information have also been proposed by others skilled in the art, and may be used to generate the products contemplated herein. This apparatus, even though invented by another, is presented hereinbelow the interest of disclosing other useful and potentially preferable approaches by which the teachings of my invention may be implemented.

Where an array of high velocity jets may be individually controlled in response to pattern information, the apparatus shown in FIGS. 11 through 17, may be employed.

Figure 11:
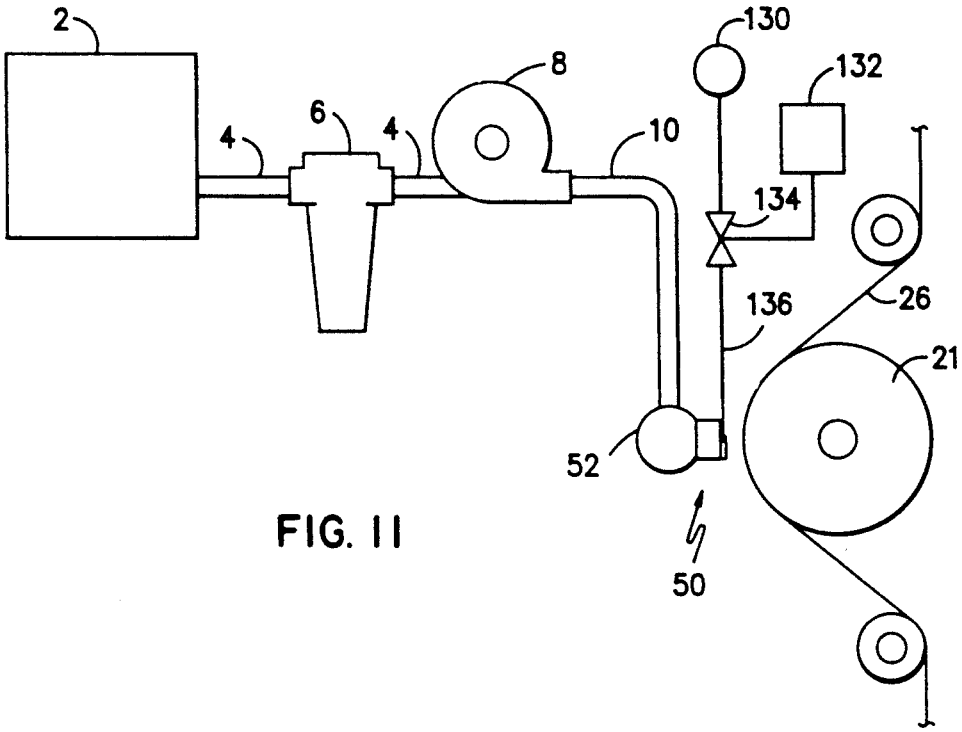
FIG. 11 is an overview of yet another apparatus which may be used to generate the novel products disclosed herein.

FIG. 11 depicts an overall view of an apparatus designed to use a combination manifold/stream forming/-stream interrupting apparatus 50, which is depicted in more detail in FIGS. 12 through 17. Pump 8 is used to pump, via suitable conduits 4,10, a working fluid such as water from a suitable source of supply 2 through an appropriate filter 6 to a high pressure supply duct 52, which in turn supplies water at suitable dynamic pressure (e.g., between 75 p.s.i.g. and 3,000 p.s.i.g.) to the manifold apparatus 50. Also depicted in FIG. 11 are the conduits 136 for directing the control fluid, for example, slightly pressurized air as supplied from source 130, and valves 134 by which the flow of control fluid may be selectively established or interrupted in response to pattern information supplied by pattern data source 132. As will be explained in greater detail hereinbelow, establishing the flow of control fluid to manifold apparatus 50 via conduits 136, pressurized no higher than approximately one-twentieth of the pressure of the high velocity water, causes an interruption in the flow of high velocity water emanating from manifold apparatus 50 and striking the substrate placed against backing member 21. Conversely, interrupting such control fluid flow causes the flow of high velocity water to impact the substrate 26 placed against backing member 21.

Figure 12:
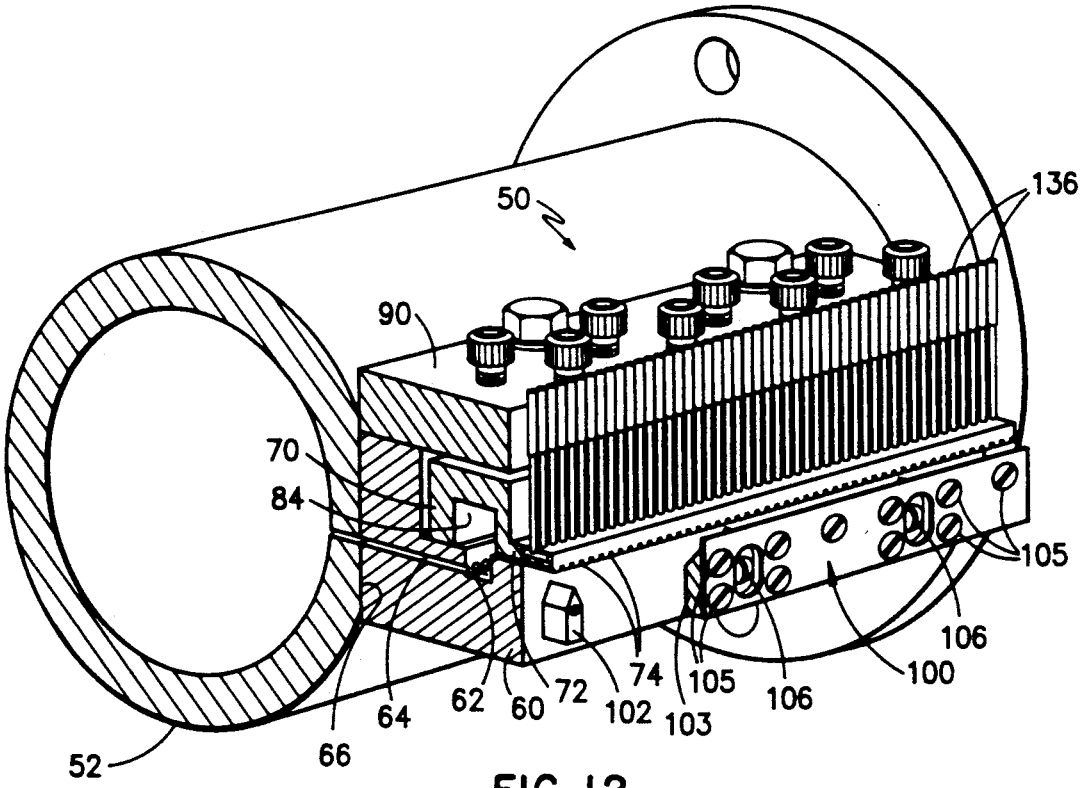
FIG. 12 is a perspective view of the high pressure manifold assembly depicted in FIG. 11.
Figure 13:
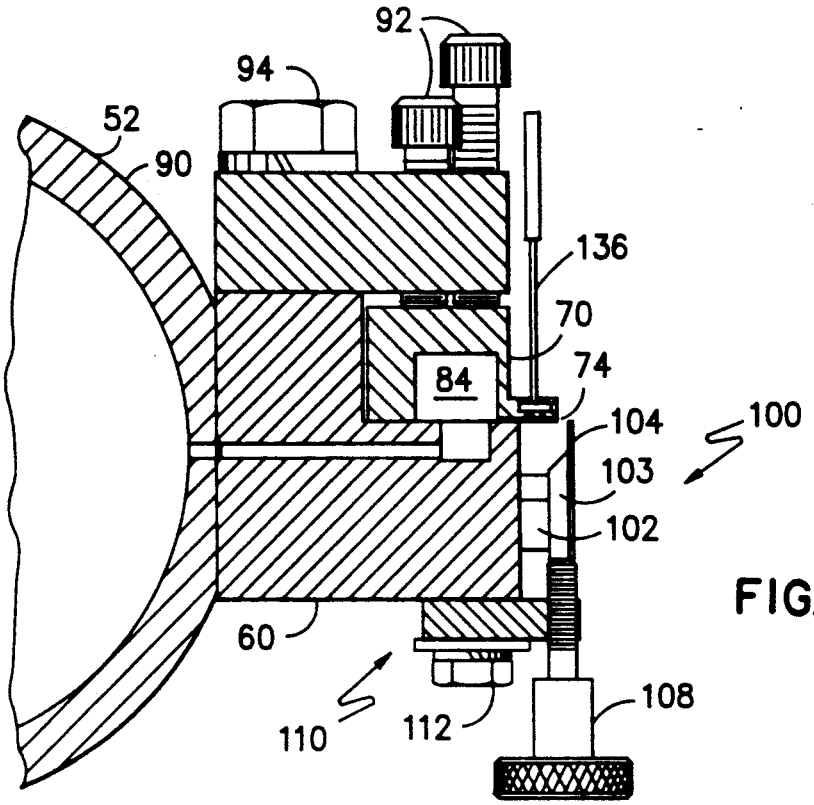
FIG. 13 is a side view of the assembly of FIG. 12, showing the alignment means used to align the containment plate depicted in FIG. 12.

Looking to FIG. 12, it may be seen that manifold assembly 50 is comprised of five basic structures: high pressure supply gallery assembly 60 (which is mounted in operable association with high pressure supply duct 52), grooved chamber assembly 70, clamping assembly 90, control fluid conduits 136, and spaced barrier plate assembly 100.

Supply gallery assembly 60 is comprised of an "L"-shaped member, into one leg of which is machined a uniform notch 62 which extends, uninterrupted, along the entire length of the assembly 50. A series of uniformly spaced supply passages 64 are drilled through the side wall 66 of assembly 60 to the corresponding side wall of notch 62, whereby notch 62 may be supplied with high pressure water from high pressure supply duct 52, the side of which may be appropriately milled, drilled, and connected to side wall 66 and the end of respective supply passages 64. Slotted chamber assembly 70 is comprised of an elongate member having an inverted hook-shaped cross-section, and having an extending leg 72 into which have been machined a series of closely spaced parallel slots or grooves 74 each having a width approximately equal to the width of the desired high velocity treatment stream, and, associated with each slot, a series of communicating control fluid passages, shown in greater detail in FIGS. 14 through 17. These control passages are connected to control fluid conduits 136, through which is supplied a flow of low pressure control fluid during those intervals in which the flow of high pressure fluid flowing through slots 74 is to be interrupted.

As shown in FIGS. 14 through 17, the control fluid passages are comprised of a pair of slot intercept passages 76 spaced along the base of each slot and connected to an individual elongate chamber 78 which is aligned with the axis of its respective slot 74. Each slot 74 has associated with it a respective chamber 78, which in turn is connected, via respective individual control supply passages 80, to a respective control fluid conduit 136. In practice, chambers 78 may be made by drilling a passage of the desired length from the barrier plate (104) side of chamber assembly 70, then plugging the exit hole in a manner appropriate to contain the relatively low pressure control fluid.

Figure 14:
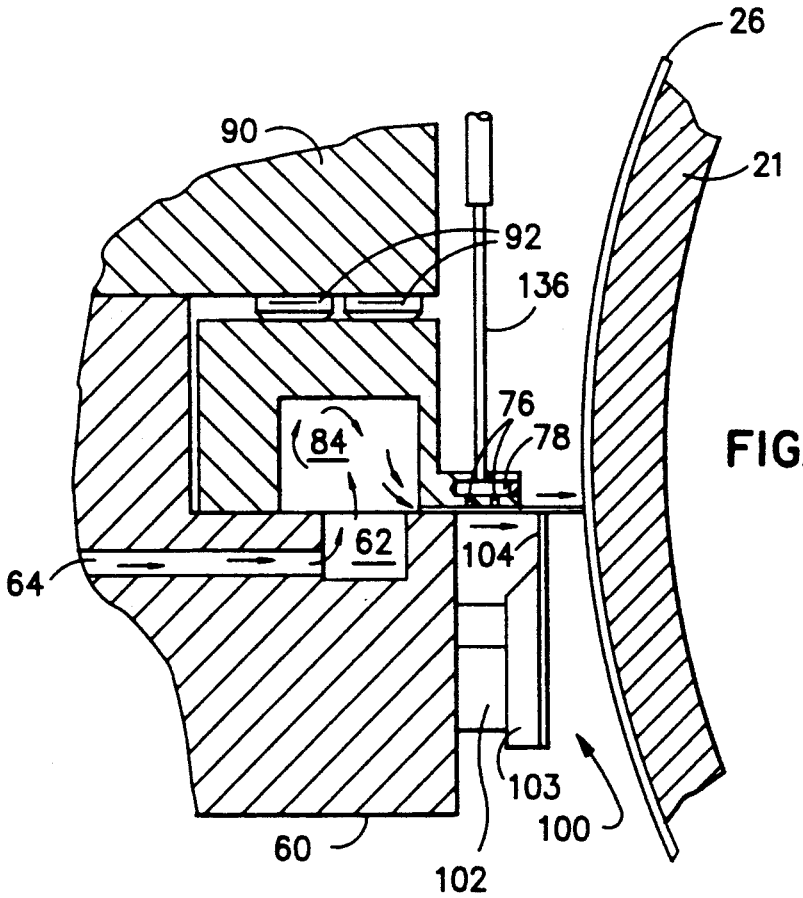
FIG. 14 is a cross-section view of the assembly of FIG. 12, without the alignment means, showing the path of the high velocity fluid through the manifold, and the path of the resulting fluid stream as it strikes a substrate placed against the support roll.
Figure 15:
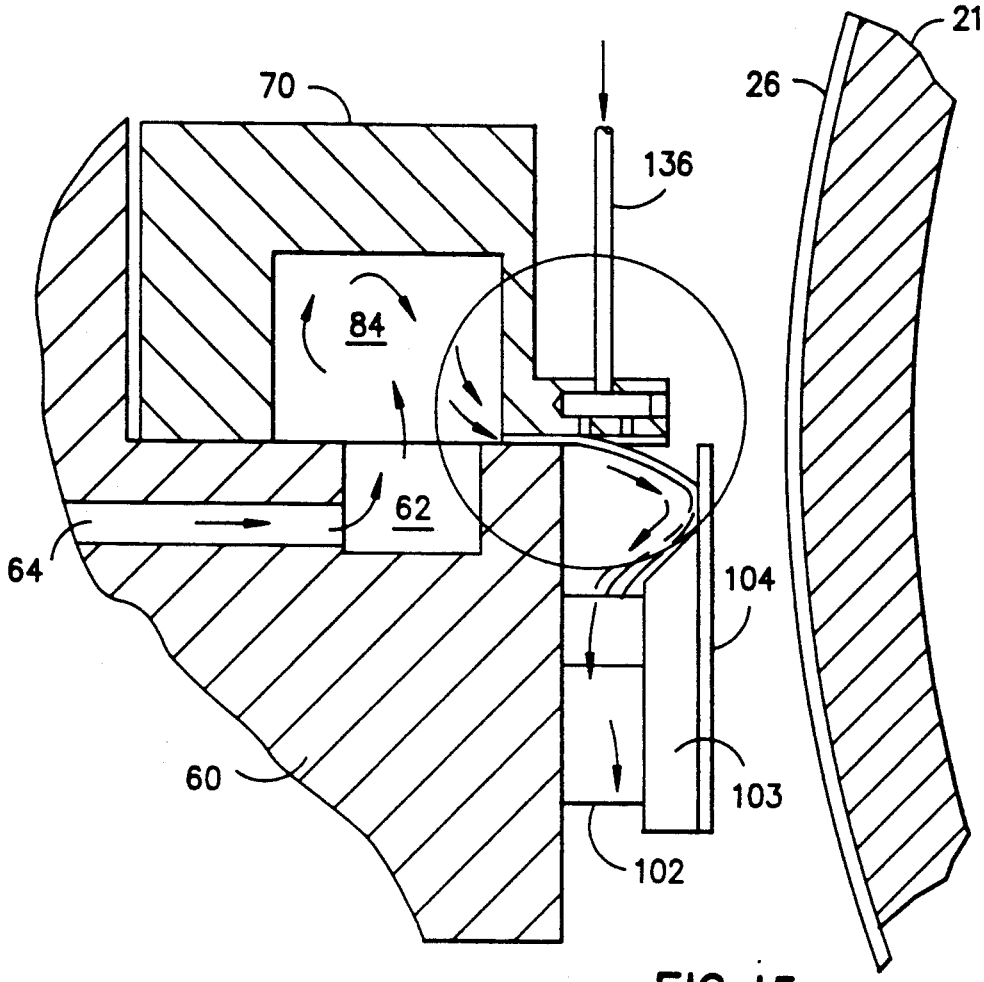
FIG. 15 depicts a portion of the view of FIG. 14, but wherein the fluid stream is prevented from striking the target substrate by the deflecting action of a stream of control fluid.

Grooved chamber assembly 70 is positioned, via clamping assembly 90, within supply gallery assembly 60 so that its "C"-shaped chamber is facing notch 62, thereby forming a high pressure distribution reservoir chamber 84 in which, as depicted in FIGS. 14 and 15, high pressure water enters notch 62 via passages 64, enters reservoir chamber 84, and flows through slots 74 towards the substrate 26. Clamping assembly 90 is provided along its length with jacking screws 92 as well as bolts 94 which serve to securely attach clamping assembly 90 to supply gallery assembly 60 along the side opposite barrier plate assembly 100. It is important to note that the configuration and placement of slotted chamber assembly 70 provides for slots 74 to be entirely covered over the portion of slots closest to reservoir chamber 84, but provides for slots 74 to be uncovered or open over the portion of slots nearest barrier plate assembly 100, and particularly over that portion of the slots 74 opposite and immediately downstream of slot intercept passages 76.

Associated with supply gallery assembly 60 and attached thereto via tapered spacing supports 102 is spaced barrier plate assembly 100, comprising a rigid plate 104 having an edge which is positioned to be just outside the path of the high velocity stream as the stream leaves the confines of slot 74 and exits from the end of chamber assembly 70, and crosses the plane defined by plate 104. To ensure rigidity of plate 104, elongate backing plate 103 is securely attached to the inside surface of plate 104, via screws 105 positioned along the length of plate 104. Screws 106, which thread into threaded holes in spacing supports 102, are used to fix the position of plate 104 following alignment adjustment via threaded alignment bolts 108. Bolts 108 are associated with alignment guide 110 which is, at the time of machine set up, attached to the base of supply gallery assembly 60 via screws 112. By turning bolts 108, precise and reproducible changes in the relative elevation of plate 104, and thereby the clearance between the distal or upstanding edge of plate 104 and the path of the high velocity fluid jet(s), may be made. After the plate 104 is brought into satisfactory alignment relative to slots 74, screws 106 may be tightened and alignment guide 110, with bolts 108, may be removed, thereby fixing the edge of plate 104 in proper relation to the base of slots 74.

FIGS. 14 and 15 depicts a fluid jet(s) impacting the substrate 26 perpendicular to the plane of tangency to the surface of support roll 21 at the point of impact; in some cases, however, it may be advantageous to direct the fluid jet(s) at a small angle relative to such plane, in either direction (i.e., either into or along the direction of rotation of roll 21). Generally, such angles (hereinafter referred to as "inclination angles") are about twenty degrees or less, but may be more for some applications.

As depicted in FIG. 15, when no control fluid is flowing through conduit 136 and slot intercept passages 76, highly pressurized water from passages 64 fills high pressure reservoir chamber 84 and is ejected towards substrate 26, via slots 74, in the form of a high velocity stream which passes in close proximity to the distal or upstanding edge of barrier plate 104. The high velocity streams are formed as the high pressure water is forced through the passages formed by covered portions of slots 74; the streams retain substantially the same cross section as they travel along the uncovered portion of slots 74 between supply gallery assembly 60 and barrier plate 104, diverging only slightly as they leave the confines of the slots 74, pass the upstanding portion of barrier plate 104, and strike the substrate 26.

Figure 16:
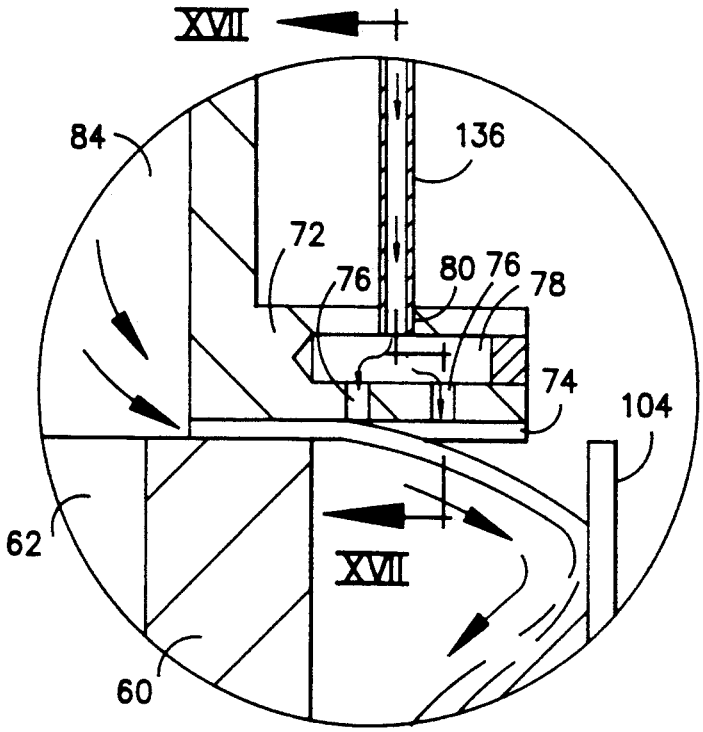
FIG. 16 is an enlarged, cross-section view of the encircled portion of FIG. 15.

As depicted in FIGS. 15 and 16, when a "no treatment" signal is sent to a valve controlling the flow of control fluid in a given conduit 136, a relatively low pressure control fluid, e.g., air, is made to flow from the selected conduit 136 into the associated slot intercept passages 76 of a given slot 74, and the high velocity stream traveling along that slot is subjected to a force directed to the open side of the slot 74. Absent a counteracting force, this relatively slight pressure introduced by the control fluid causes the selected high velocity stream to leave the confines of the slot 74 and strike the barrier plate rather than the substrate, where its energy is dissipated, leaving the substrate untouched by the energetic stream. In a preferred embodiment of the apparatus, a separate electrically actuated air valve such as the Tomita Tom-Boy JC-300, manufactured by Tomita Co., Ltd., No. 18-16 1 Chome, Ohmorinaka, Ohta-ku, Tokyo, Japan, is associated with each control stream conduit. A valve actuating signal may be generated by conventional computer means, i.e., via an EPROM or from magnetic media, and routed to the respective valves, whereby the high velocity treatment streams may be selectively and intermittently actuated in accordance with supplied pattern data.

Figure 17:
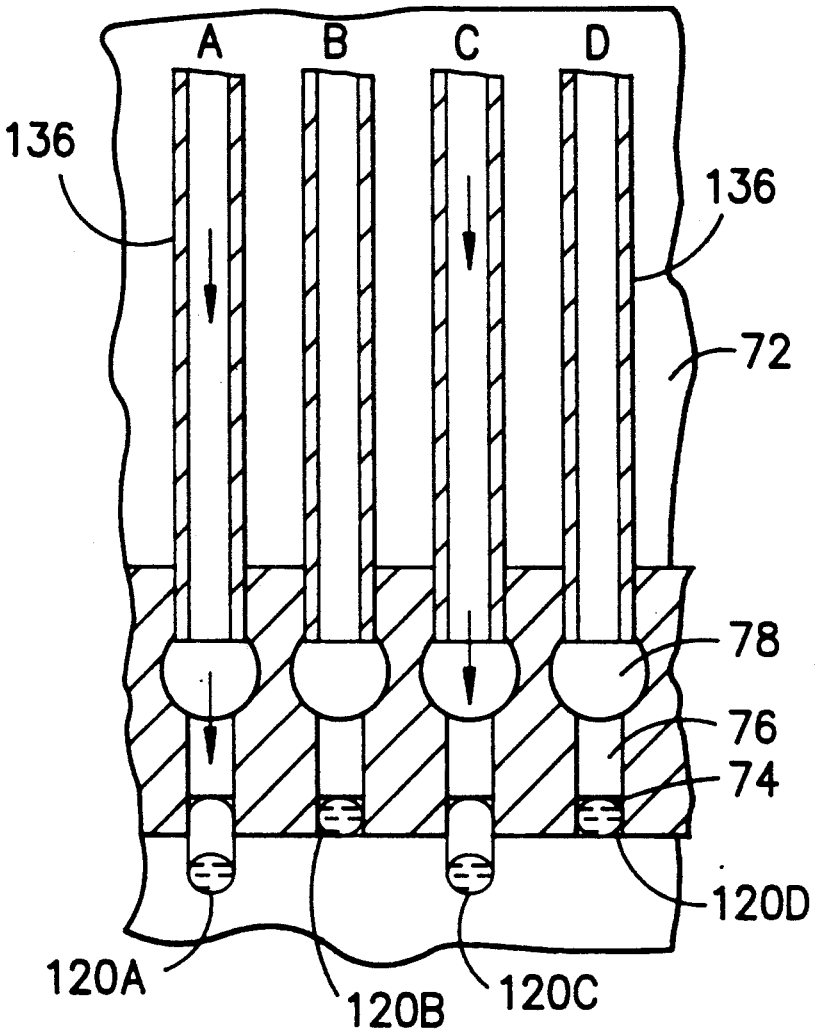
FIG. 17 is a cross-section view taken along lines XVII—XVII of FIG. 16, depicting the deflection of selected working fluid jets by the flow of control fluid.

FIG. 17 is a section view taken through lines XVII—XVII of FIG. 16, and diagrammatically indicates the effects of control fluid flow in conduits 136. As indicated, low pressure control fluid is flowing in control stream conduits 136 identified as "A" and "C", while no control fluid is flowing in conduits 136 identified as "B" and "D". In conduits "A" and "C", the high velocity jets 120A and 120C, respectively, have been dislodged from the lateral walls of slots 74 and are being deflected on a trajectory which will terminate on the inner surface of barrier plate 104. In contract, no control fluid is flowing in conduits 136 identified as "B" and "D"; as a consequence, the high velocity jets 120B and 120D, laterally defined by the walls of slots 74, are on a trajectory which will avoid the upstanding edge of barrier plate 104 and terminate on the surface of roll 21, or substrate 26 supported thereby.

Figure 50:
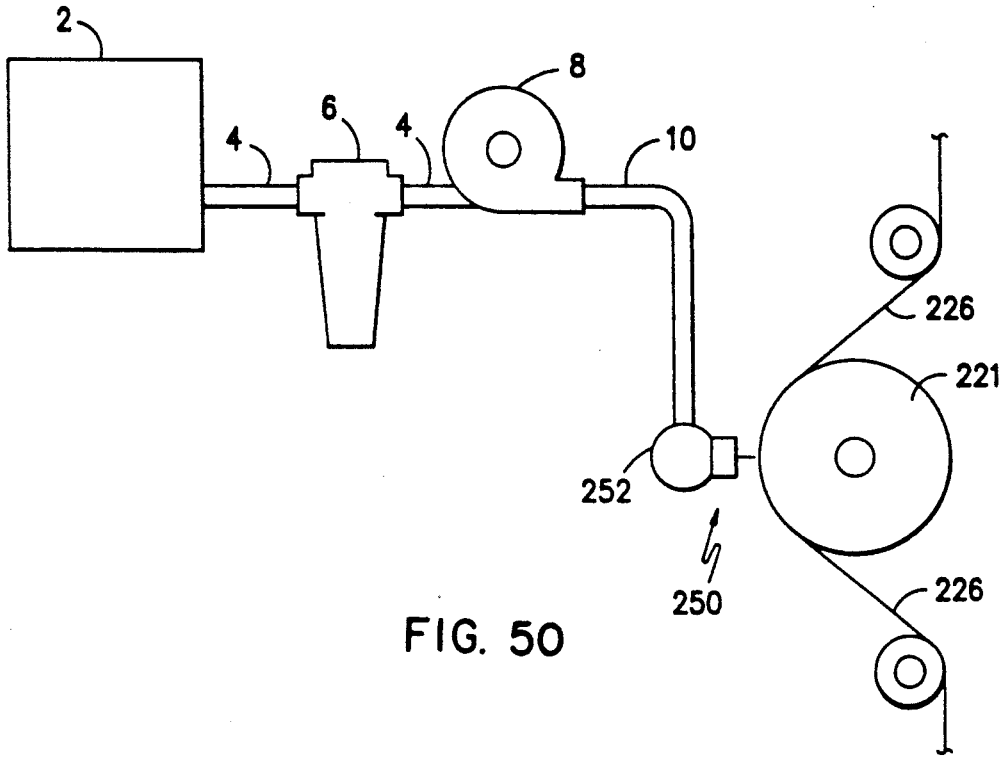
FIG. 50 is a schematicized side view of an apparatus which utilize fluid jets at an angle to remove stress lines.

An alternative embodiment is shown in FIGS. 50, 51, 52 and 53. This embodiment is an improvement which eliminates wrinkles, puckers, troughs and valleys as well as stress lines while leaving the width of the woven or knitted fabric the same. FIG. 50 depicts an overall view of the apparatus to eliminate stress lines, which is depicted as numeral 250, which is characterized in more detail in FIGS. 51 through 53. Pump 8 is used to pump, via suitable conduits 4 and 10, a working fluid such as water from a suitable source of supply 2 through an appropriate filter 6 to a high pressure supply duct 252, which in turn supplies water at suitable dynamic pressure (e.g., between 75 p.s.i.g. and 3,000 p.s.i.g.) to the manifold apparatus 250. The fluid thereby emanates from the manifold apparatus 250 thereby striking the substrate 226 placed against the backing member 221.

Figure 51:
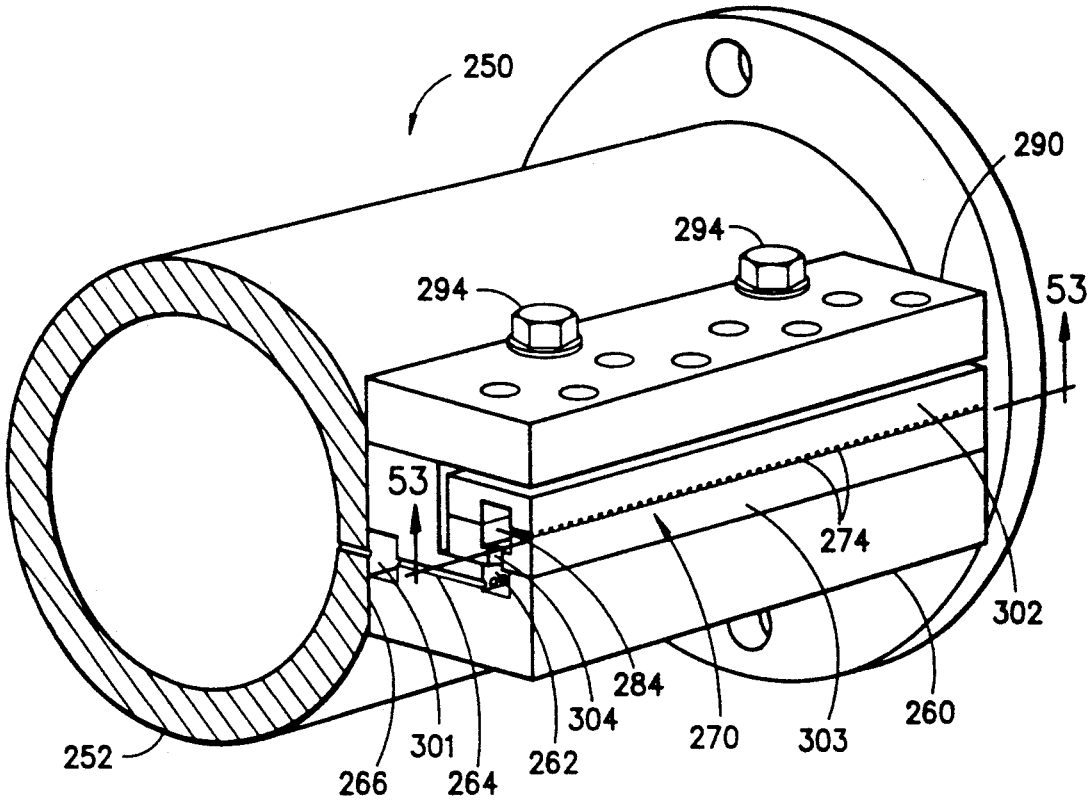
FIG. 51 is a perspective view of the high pressure manifold assembly depicted in FIG. 52.

Looking to FIG. 51, it may be seen that manifold assembly 250 is comprised of three basic structures: a high pressure supply gallery assembly 260 (which is mounted in operable association with the high pressure supply duct 252), slotted chamber assembly 270 and clamping assembly 290.

Supply gallery assembly 260 is constitutes an "L"-shaped member, into one leg of which is machined a uniform notch 262 which extends, uninterrupted, along the entire length of the assembly 250. There is a rectangular uniform notch 301 which is in the other vertical leg of the "L"-shaped member 260 and adjacent to the high pressure supply duct 252. A series of uniformly spaced supply passages 264 are drilled through the rectangular uniform notch 301 and extend to the corresponding side wall of notch 262, whereby notch 262 may be supplied with high pressure water from high pressure supply duct 252, the side of which may be milled, drilled, and connected to notch 301 which is along the side wall 266 of the assembly 260. Slotted chamber assembly 270 is comprised of dual elongate "U"-shaped members 302, 303 having a rectangular cross-section 284 therebetween. The upper "U" shaped member 302 has a series of machined closely spaced slots 274 each having a width approximately equal to the width of the desired high velocity treatment stream.

Figure 52:
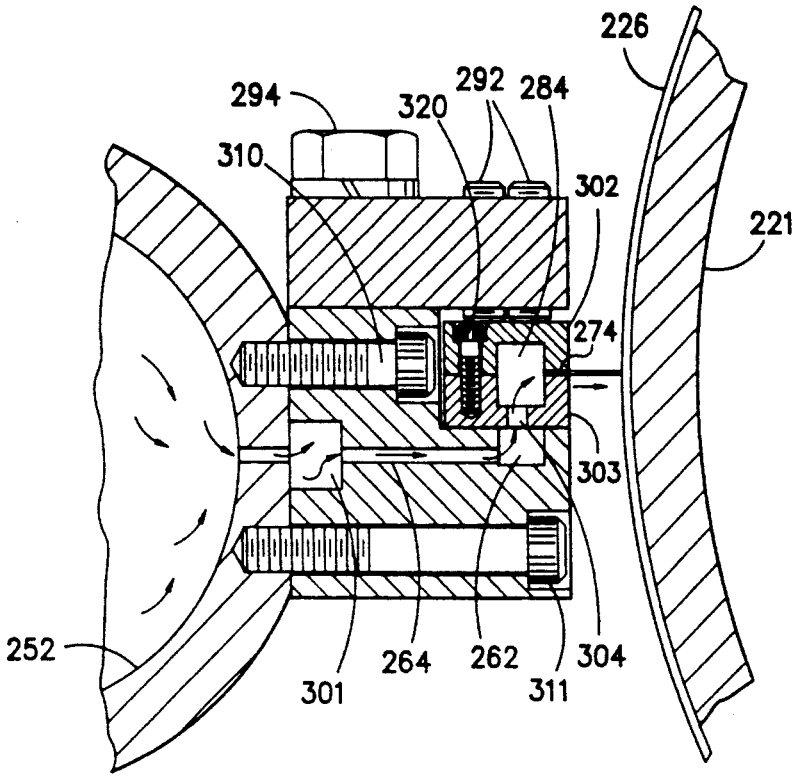
FIG. 52 is a cross section view of the assembly of FIG. 51, showing the path of the high velocity fluid through the manifold, and the path of the resulting fluid stream as it strikes a substrate placed against the support roll.

Referring now to FIGS. 51 and 52, grooved chamber assembly 70 is positioned, via clamping assembly 290, within supply gallery 260 so that its rectangular cross-section 284 communicates via parallel spaced holes 264 to notch 262 which thereby forms both an upper and lower high pressure distribution reservoirs, respectively, so that fluid enters from a supply duct 252 and then into a high pressure distribution reservoir formed by notch 301. The water then travels via supply passages 264 into a lower high pressure distribution reservoir formed by notch 262 and then goes through holes 304 into an upper high pressure distribution chamber 284 formed by dual elongate "U"-shaped members 302 and 303. Water then flows through slots 274 towards the substrate 226. Clamping assembly 290 is provided along its length with jacking screws 292 as well as bolts 294 which serve to securely attach clamping assembly 290 to supply gallery assembly 260.

As shown in FIG. 52, the manifold assembly 250 is connected to the high pressure supply gallery assembly 260 by means of bolts 310 and 311 respectively. There are a series of bolts 320 which connect the lower "U"-shaped member 303 with the upper "U"-shaped member 302.

Figure 53:
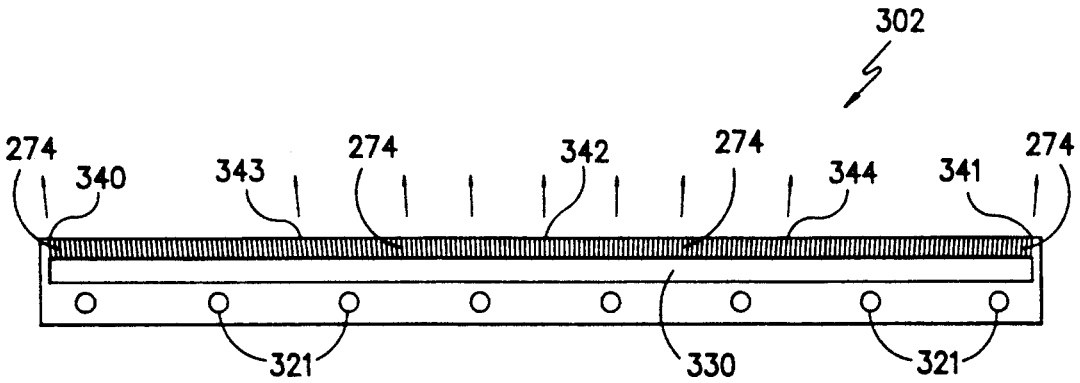
FIG. 53 is a cross sectional view taken on line 53—53 of FIG. 51.

Referring now to FIG. 53, the upper elongate "U"-shaped member 302 with bolt holes 321 to accommodate bolts 320. There is a rectangular channel 330 which forms one-half of the rectangular cross-section 284.

The means of eliminating wrinkles, troughs, stress lines, and valleys involves the slots 274. In the preferred embodiment, there are forty slots per inch, but this can vary. Instead of having all of the slots parallel to each other, the slots between the point 343 to one lateral edge of the member 302 which is at point 340 are at an angle from the longitudinal axis of the member 302 directed toward the outer lateral edge point 340. The slots between the point 344 to the other lateral edge of the member 302 which is point 341 are at an angle from the longitudinal axis of the member 302 directed toward the outer lateral edge point 341. The angle deviation from the longitudinal axis of the member 302 that provides good results is five degrees. This angle can vary widely, with the optimal deviation angle depending on the type of fabric utilized. The slots 274 between point 343 and point 342 of the member 342 monotonically deviate between substantially perpendicular to the longitudinal axis of the member 302 at the point 342 to the desired outward angle deviation at point 343. The point 342 can be anywhere in the middle one-third of the member 302, but preferable at the midpoint. The word "monotonical", in this application, means to either increase or stay the same. This is duplicated between point 342 and point 344. By directing fluid in this manner, stretches the material 226 outwards along its width. This device may also be designed so that there is no portion on the left or right at a set angle and there is monotonical deviation outward from each side of a fixed point, such as point 342, until the outer lateral edges of the fabric. The manifold apparatus 250 can be at a variety of angles in relationship the substrate 226.

This apparatus and process eliminates all wrinkles, puckers, troughs and valleys as well as stress lines in the material, even at higher fluid pressures.

These examples demonstrate, without intending to be limiting in any way, the method by which fabrics of the present invention have been generated.

EXAMPLE 1

An apparatus similar to that schematically depicted in FIG. 1 was used, in accordance with the following specifications. Fabric: a 65/35 polyester/cotton poplin having a warp comprised of 25/1 polyester/cotton and a fill comprised of 25/1 polyester/cotton, a pick count of 52, an end count of 102, and a weight of 4.5 ounces per square yard. The fabric was cross-dyed, with the polyester being dyed blue and the cotton being dyed white.

Nozzle diameter: 0.017 inch.

Fluid: water, at a pressure of 2200 p.s.i.g.

Pattern gauge: 20 lines per inch.

Source of pattern data: EPROM, with appropriate associated electronics of conventional design.

Roll: solid, smooth aluminum, rotating at a circumference speed of 10 yards per minute in the same direction as warp yarns in fabric.

Figure 18:
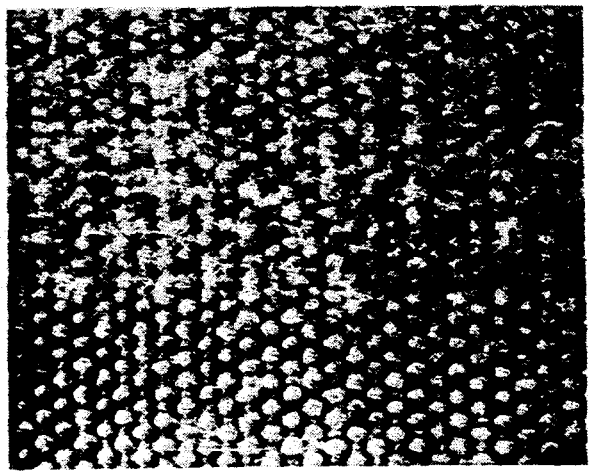
FIGS. 18 and 19 are photomicrographs (10×) of the face of the pattern fabrics of Example 1, using reflected and transmitted light, respectively, with the treated portion near the top.
Figure 19:
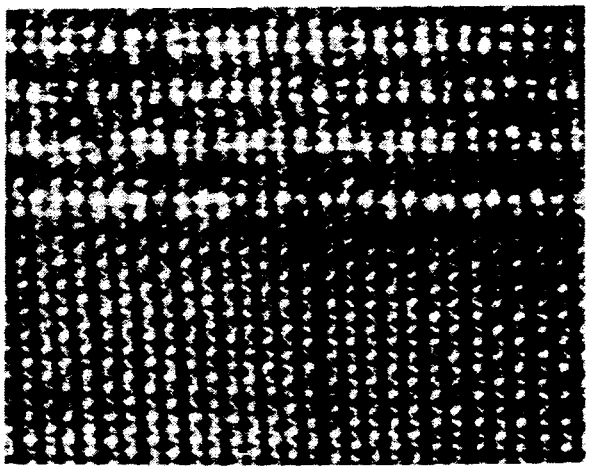
Figure 20:
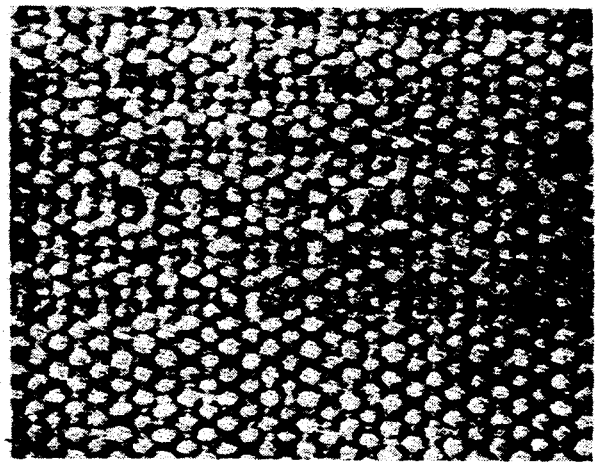
FIG. 20 is a reflected light photomicrograph (10×) of the back of the fabric of Example 1.
Figure 21:
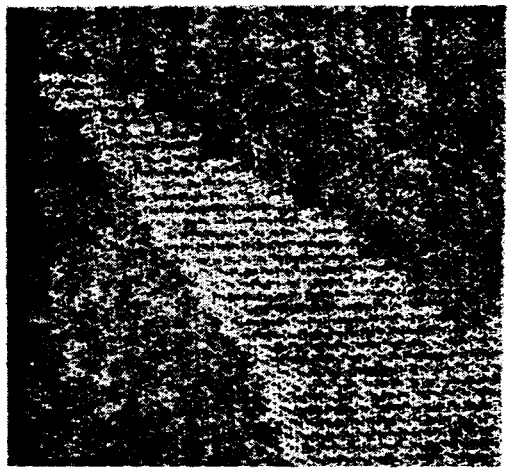
FIG. 21 is a reflected light photomicrograph (1.9×) of the face of the fabric of Example 2.
Figure 22:
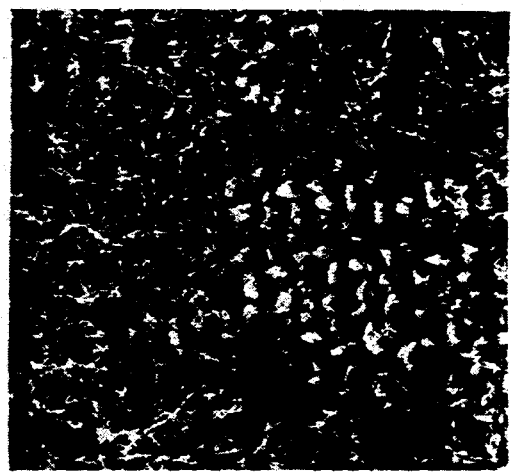
FIG. 22 is a reflected light photomicrograph (10×) of the face of the fabric of Example 2, with the treated portion to the left and above.
Figure 23:
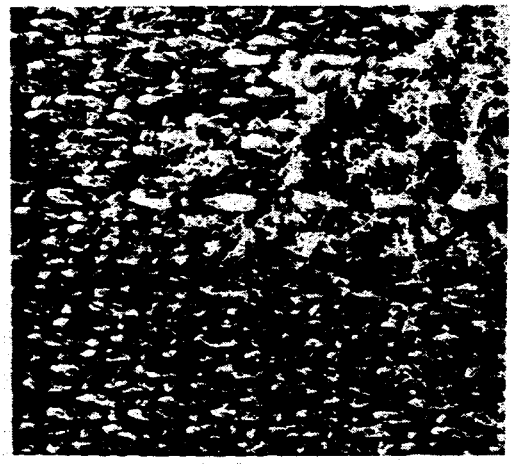
FIG. 23 is a reflected light photomicrograph (10×) of the back of the fabric of Example 2, with the treated portion near the upper right.
Figure 24:
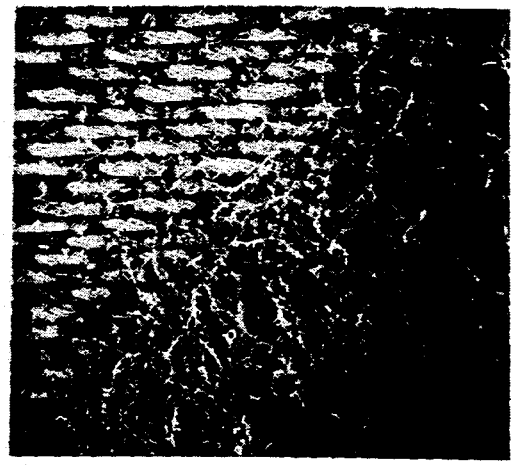
FIG. 24 is a scanning electron micrograph (15×) of the back of the fabric of Example 2, with the treated portion near the lower right.
Figure 25:
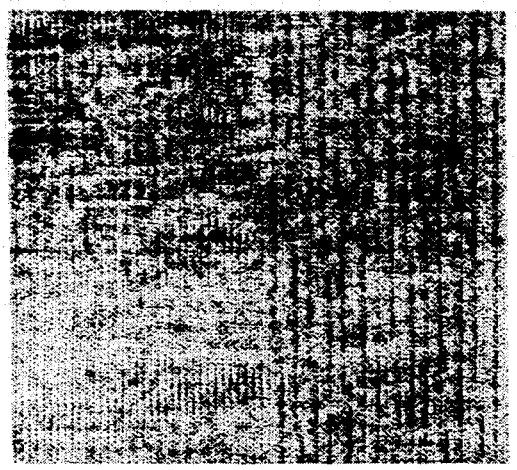
FIGS. 25 and 26 are reflected light photomicrographs (1.9× and 10×, respectively) of the face of the fabric of Example 3, with the treated portion to the right.

In this Example, the entire fabric surface was treated in a series of closely spaced lines, except for a small control area. The water stream was traversed across the fabric in the warp direction. The resulting effect on the fabric surface, both front and back, may be seen from examination of FIGS. 18 through 20.

On the impingement side of the fabric, the water stream appears to have opened the yarn. Free-ended fibers were raised, and appeared to be entangled to a minor degree. A substantial number of free ends were driven through the fabric and appeared as raised fibers from the fabric back. Some breakage of the cotton fibers was observed. The yarns have been laterally displaced where the stream impacted the fabric.

EXAMPLE 2

The procedures of Example 1 were followed, except for the following:

Fabric: a 2×1 twill fabric, with an end count of 84, and a pick count of 46. The warp yarns are 14/1 polyester/cotton 65/35; the fill yarns are 14/1 polyester/cotton 65/35. The fabric is napped on the face, and has a weight of 6.83 ounces per square yard.

The resulting pattern fabric may be seen in the photomicrographs of FIGS. 21 through 24. Most fibers comprising the nap on the fabric face have been pushed into the substrate. A significant portion of many of the fibers comprising the nap have been pushed through the substrate and form a nap-like surface on the back of the fabric. The path of the water jet which impacts the fabric may be seen on both the face and back of the fabric. There is little change in the light transmittance, but a significant change in the light reflectance between the treated and untreated areas.

EXAMPLE 3

The procedures of Example 1 were followed except for the following:

Fabric: A 100% spun polyester jersey knit have a weight of five ounces per square yard.

Pattern gauge: Approximately 16 lines per inch.

Figure 26:
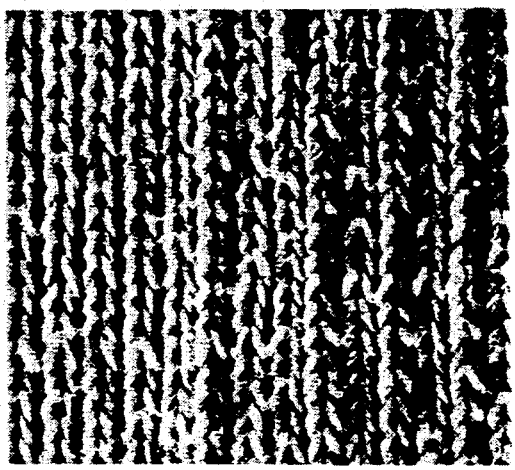
Figure 27:
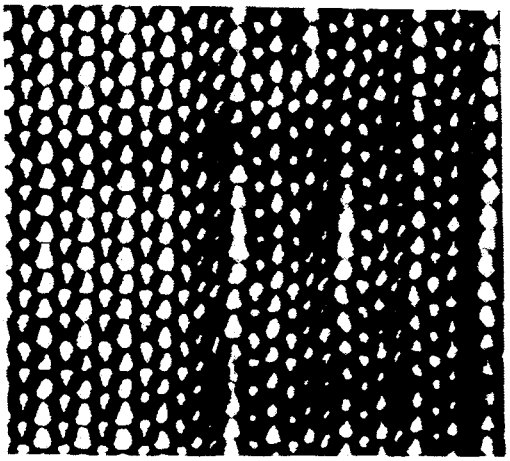
FIG. 27 is a transmitted light photomicrograph (10×) of the back of the fabric of Example 3, with the treated portion to the right.
Figure 28:
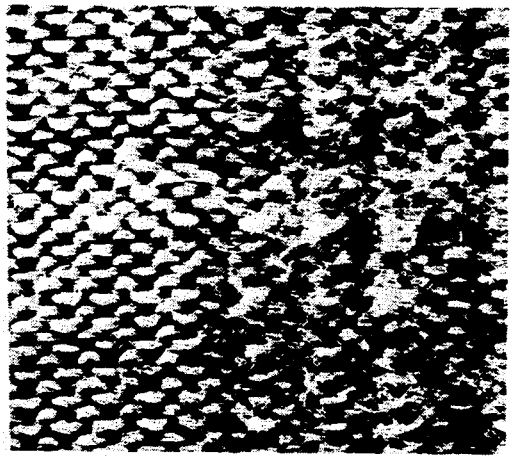
FIG. 28 is a reflected light photomicrograph (10×) of the back of the fabric of Example 3, with the treated portion to the right.

The water stream was directed onto the face of the fabric. The resulting pattern fabric may be seen in the photomicrographs of FIGS. 25 through 28. As may be seen, a multi-level effect has been introduced in the wales in the form of generally "U"-shaped grooves which form corresponding ridges on the opposite side of the fabric. FIGS. 26 and 27 show a compaction of a knit structure in the region of the grooves. Yarn bulking and spreading in the treated area are observed. There is a significant degree of fiber raising on the back of the fabric, as shown in FIG. 28.

EXAMPLE 4

The procedures of Example 1 were followed, except for the following:

Fabric: a 65/35 polyester/cotton sanded twill having a warp and fill comprised of 14/1 yarn having 85 ends and 54 picks in a 3×1 weave and having a fabric weight of 7.34 ounces per square yard.

Nozzle diameter: 0.020 inch

Fluid: water at a pressure of 2500 p.s.i.g.

Figure 29:
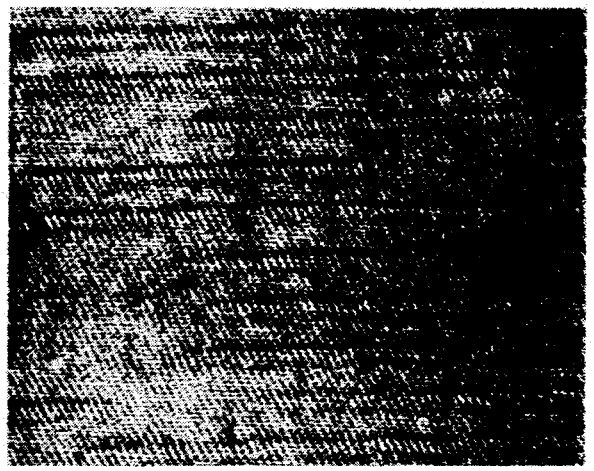
FIGS. 29 and 30 are reflected light photomicrographs (1.9× and 10×, respectively) of the face of the fabric of Example 4.
Figure 30:
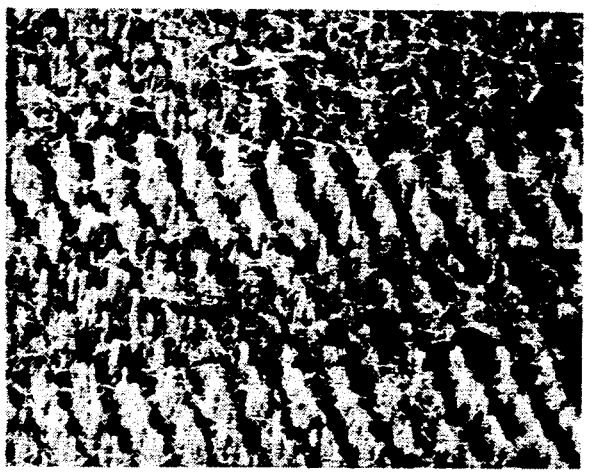
Figure 31:
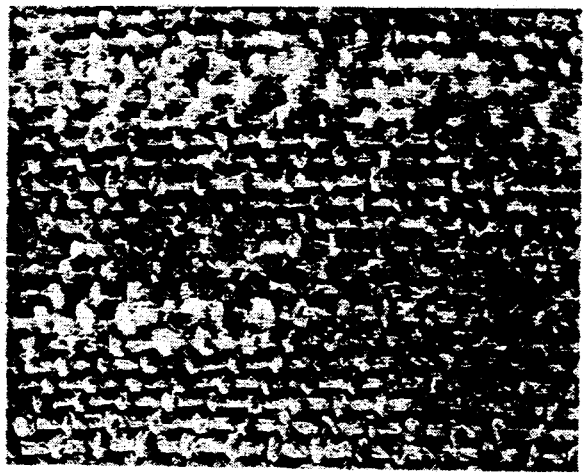
FIG. 31 is a reflected light photomicrograph (10×) of the back of the fabric of Example 4.
Figure 32:
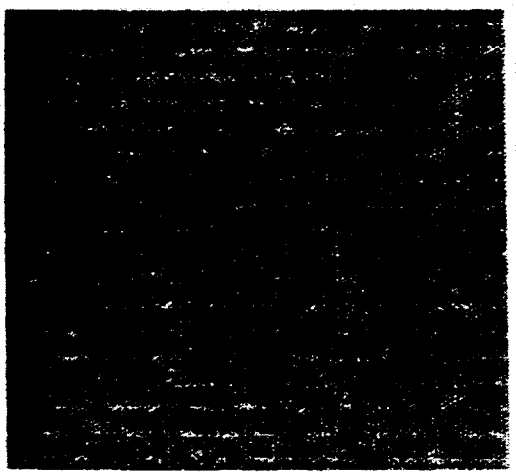
FIGS. 32 and 33 are photomicrographs (1.9×) of the face of the fabric of Example 5, using reflected and transmitted light, respectively.
Figure 33:
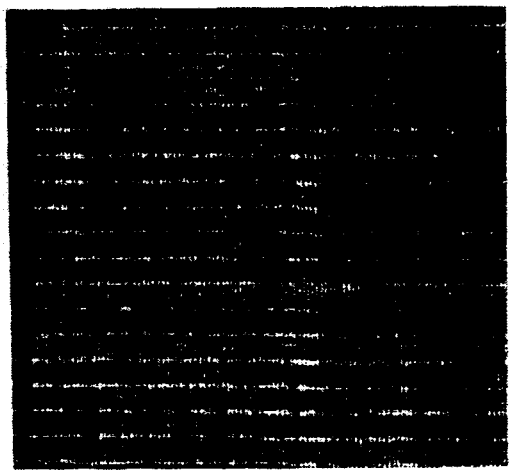
Figure 34:
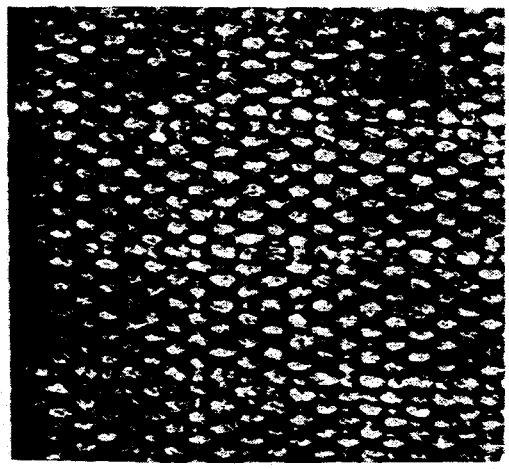
FIGS. 34 and 35 are reflected light photomicrographs (10×) of the face and back, respectively, of the fabric of Example 5.

The water stream was directed onto the face of the fabric. The resulting fabric is shown in the photomicrographs of FIGS. 29 through 31. As may be seen, there is a raising of the yarns at corresponding locations on both sides of the face and back of the fabric, resulting in the formation of ridges on exactly opposite sides of the fabric which produce a slub-like appearance. There is an opening and a bulking of the yarn in the treated areas. Surface napped fibers are produced and displaced along the treated areas. Most of such produced napped fibers are pushed through the fabric and protrude from the back surface opposite the treated areas.

EXAMPLE 5

The procedures of Example 4 were followed, except as indicated. The fabric consisted of a 65/35 polyester/cotton 1×1 plain weave having a 25/1 polyester/cotton warp and a 25/1 polyester/cotton fill, with 98 ends and 56 picks, and a fabric weight of 4.92 ounces per square yard. An apparatus similar to that depicted in FIGS. 11 through 17 was used. The water pressure was maintained at 2500 p.s.i.g., the control fluid was air, which was varied in pressure from 2 to 85 p.s.i.g. in response to externally supplied pattern information. At control fluid pressures on the order of 2 p.s.i.g., the water streams remained uninterrupted. The fabric was positioned approximately 0.37 inch from the exit apertures of slots 74. Circumferential roll speed was five yards per minute.

Figure 35:
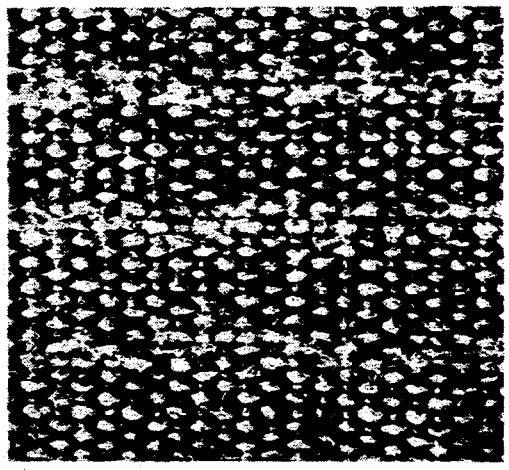

The resulting pattern fabric is shown in FIGS. 32 through 35. There is a separation of adjacent warp yarns, as well as some bulking of the treated yarns. Surface napped fibers are produced and displaced along the treated areas. Most of such produced nap fibers are pushed through the fabric and protrude from the fabric back surface opposite the treated areas, as depicted in FIG. 35.

EXAMPLE 6

Figure 36:
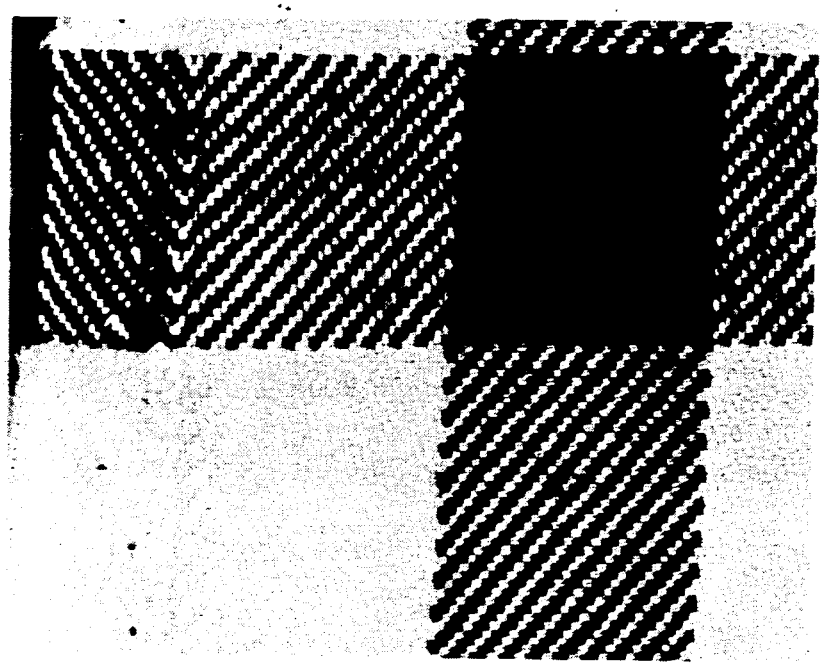
FIG. 36 is a reflected light photomicrograph (1.9×) of the untreated fabric of Example 6.
Figure 37:
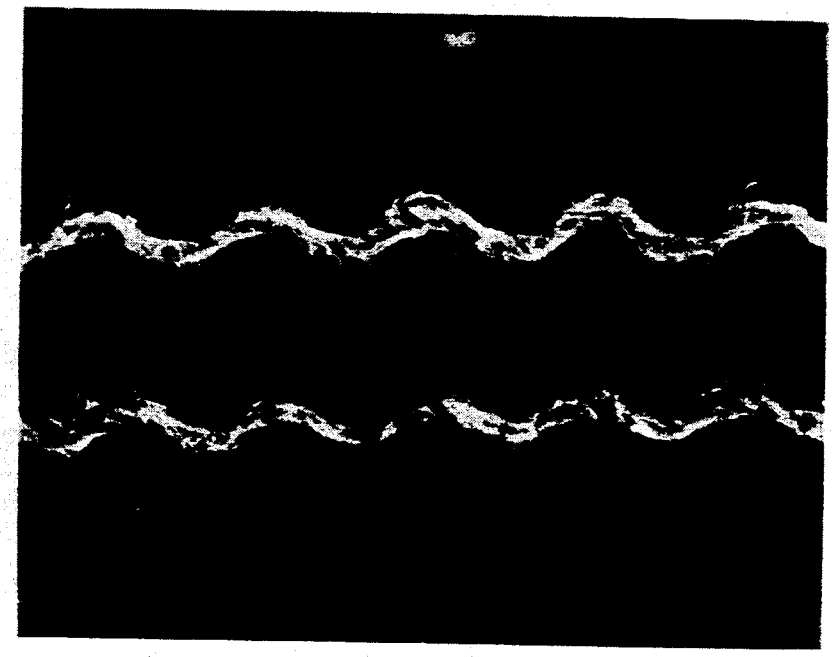
FIG. 37 is a reflected light photomicrograph (10×) of warp and fill yarns (upper and lower portions of the Figure, respectively) taken from the untreated fabric of FIG. 36.

The procedures of Example 5 were followed, except as indicated. A 100% polyester fabric containing a 13.5/1 open end spun polyester yarn in a 2×2 twill weave and having 84 ends per inch and 80 picks per inch was treated in an apparatus similar to that described in FIGS. 11 through 17. A portion of the yarns is regular dyeable polyester and a portion is cationic dyeable. The fabric is woven in a plaid construction and is piece dyed. The face of the fabric prior to treatment is shown in FIG. 36, and warp and fill yarns from the untreated fabric are shown in the upper and lower portions of FIG. 37, respectively. It should be noted that the untreated warp yarns generally show little fiber raising; although the fill yarns show significantly more fiber raising, the overall degree of fiber raising would be considered slight.

The fabric was treated in an apparatus similar to that described in FIGS. 11 through 17. The slot cross-sectional dimensions were 0.020 inch wide and 0.007 inch deep; spacing between the slots was 0.033 inch. The distance between the end of the slot and the surface of the backing member was 0.060 inch. Water at 1200 p.s.i.g. was used as the working fluid. The back of the fabric was transported past the slot array at a speed of 10 yards per minute, with the face of the fabric against the backing member and the groove longitudinal axis perpendicular to the support surface, i.e., the fabric was impacted normal to its surface. The flow of control air in all conduits was interrupted, thereby allowing uninterrupted flow of working fluid from all slots.

Figure 38:
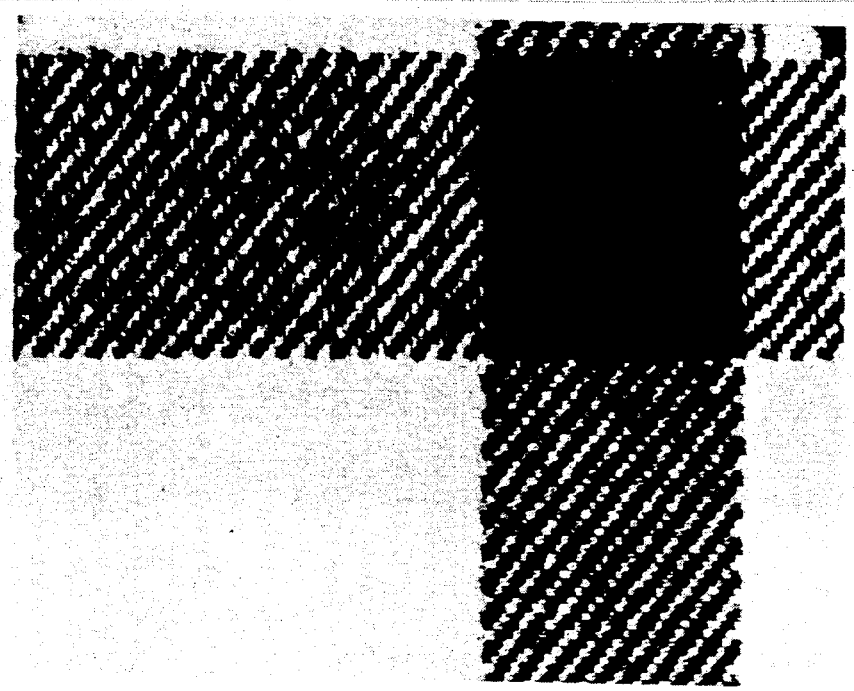
FIG. 38 is a reflected light photomicrograph (1.9×) of the fabric of FIG. 36 following the procedures set forth in Example 6.
Figure 39:
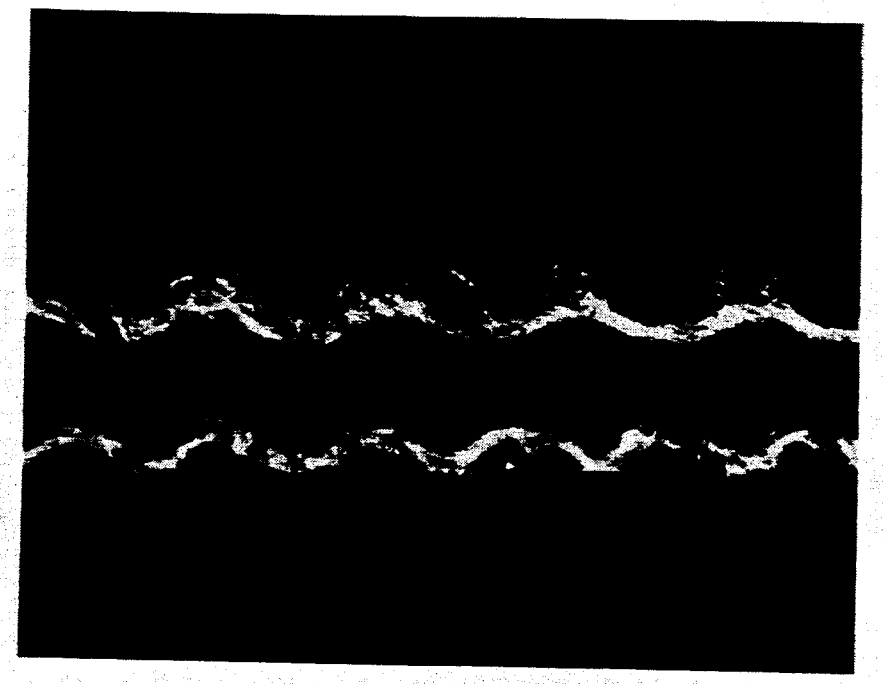
FIG. 39 is a reflected light photomicrograph of individual warp and fill (upper and lower portions of the Figure, respectively) yarns taken from the treated fabric of FIG. 38.

The treated fabric is shown in FIG. 38; warp and fill yarns taken from this sample are shown in the upper and lower portions of FIG. 39, respectively.

As can be seen, FIG. 38 shows a significant napping effect when compared with the same pattern shown in FIG. 36. This is particularly evident in the hatched portions of the pattern to the left and below of the solid pattern square. The photomicrographs of FIGS. 37 and 39 serve to confirm the significant bulking/napping effect which has been achieved on the warp yarn and, to a lesser extent, on the fill yarn.

EXAMPLE 7

Figure 40:
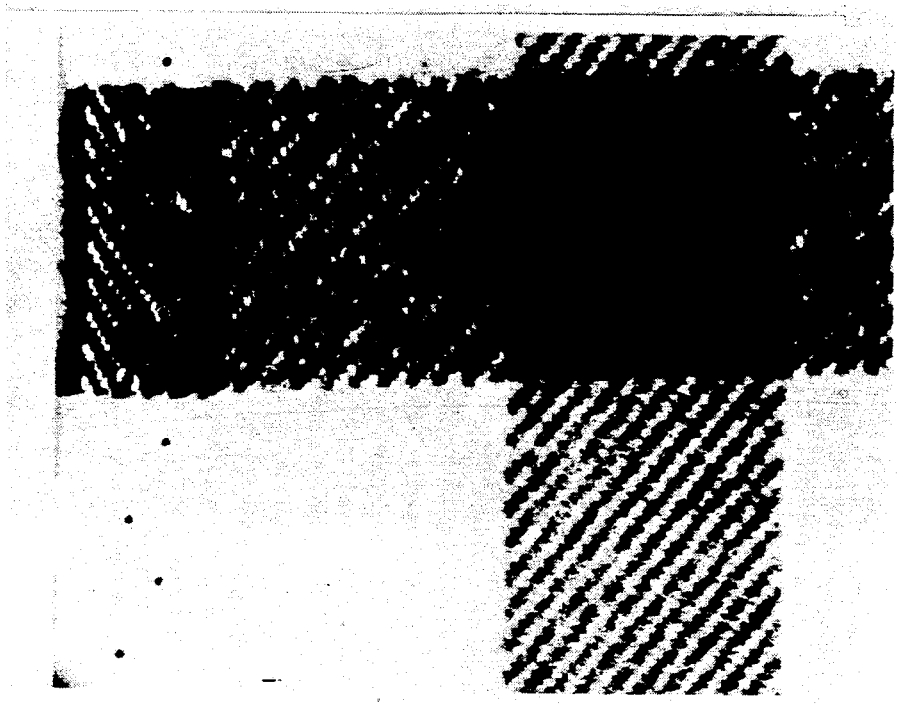
FIG. 40 is a reflected light photomicrograph (1.9×) of the fabric of FIG. 36 which has been moderately pre-napped in a conventional manner prior to treatment as set forth in Example 7.
Figure 41:
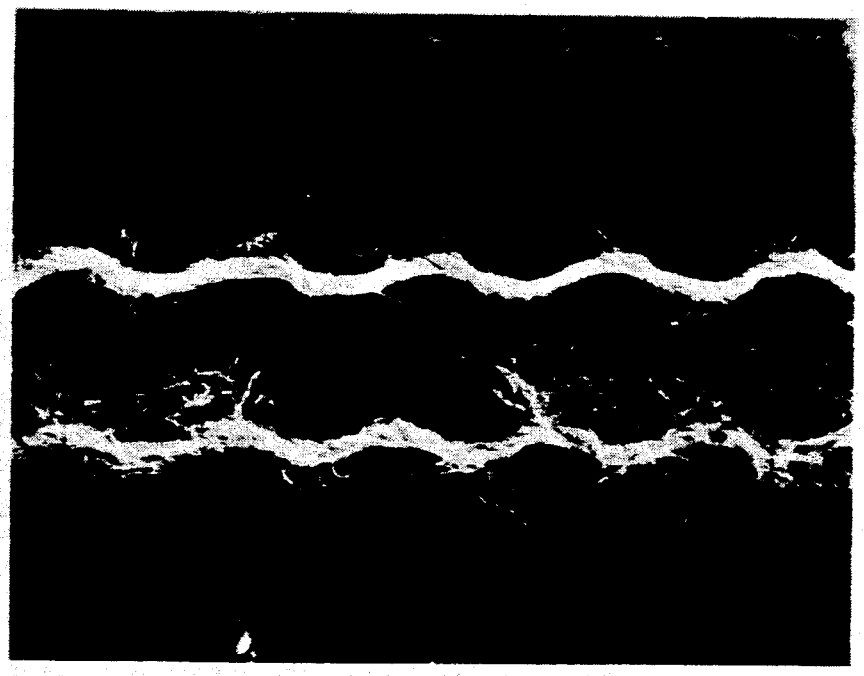
FIG. 41 is a reflected light photomicrograph of warp and fill yarns (upper and lower portions of the Figure, respectively) taken from the fabric of FIG. 40.

The procedures of Example 6 were followed, except that the starting fabric, otherwise identical to the fabric of Example 6, was moderately napped by conventional wire napping methods prior to treatment. This "pre-napped" starting fabric is shown in FIG. 40, and corresponding warp and fill yarns are depicted in the upper and lower portions of FIG. 41, respectively. FIG. 1 shows clearly that the predominant napping effect induced by conventional wire napping methods is confined to the fill yarn. This effect may also be observed in FIG. 40. The hatching pattern to the left of the solid pattern block is comprised of light colored warp yarns and dark colored fill yarns, while the hatching pattern below the solid pattern block is comprised of light colored fill yarns and dark colored warp yarns. In FIG. 40, it can be observed that the hatched pattern area to the left of the solid block appears substantially darker in overall balance than the hatched area below the solid pattern block, confirming that fill yarns in both cases were the yarns most responsible for the napped pile (i.e., the fibers comprising the napped pile, which tends to obscure the underlying hatched pattern, are predominantly from the fill yarns, rather than the warp yarns).

Figure 43:
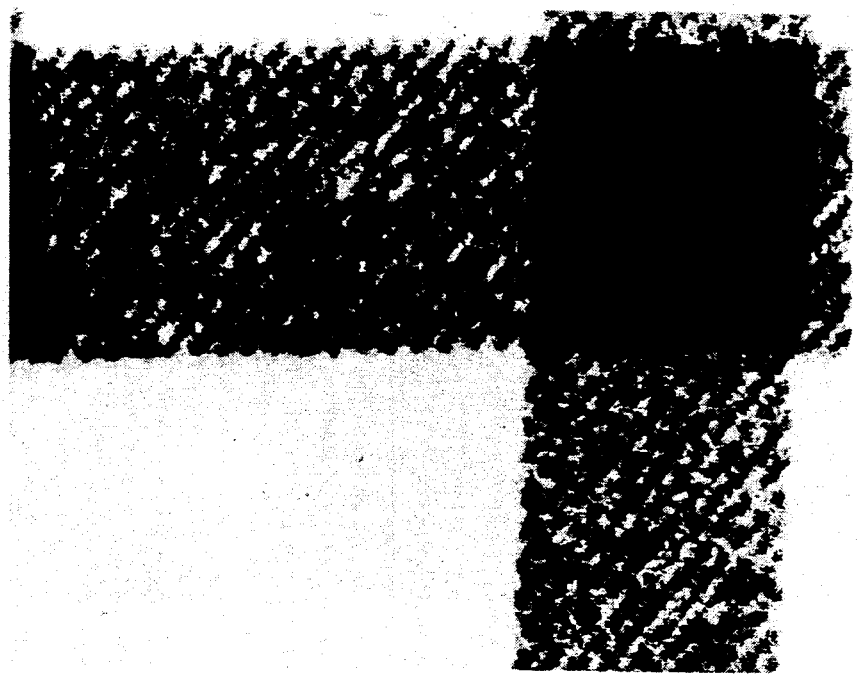
FIG. 43 is a reflected light photomicrograph (1.9×) of the resulting product of Example 7.
Figure 44:
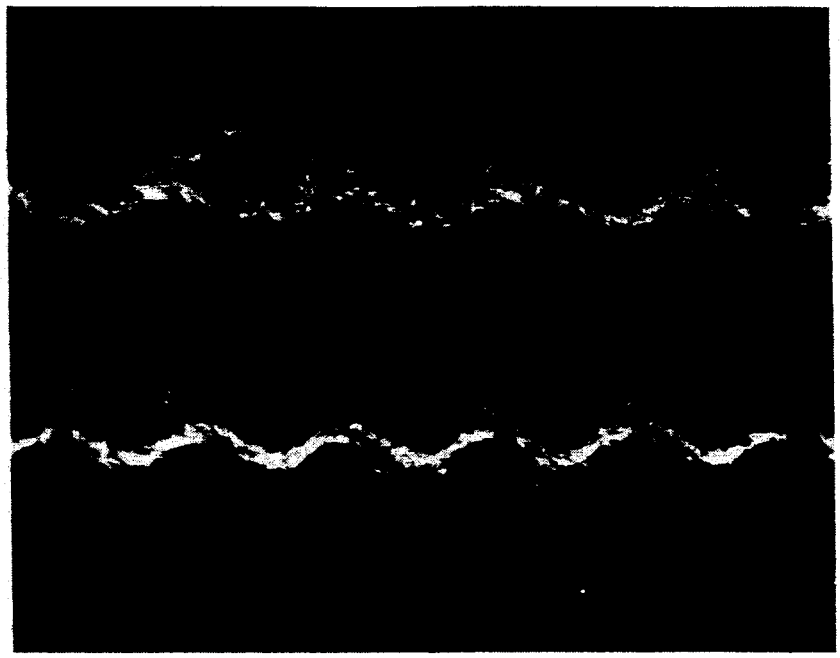
FIG. 44 is a reflected light photomicrograph (10×) of individual warp and fill yarns (upper and lower portions of the Figure, respectively) taken from the fabric of FIG. 43.
Figure 45:
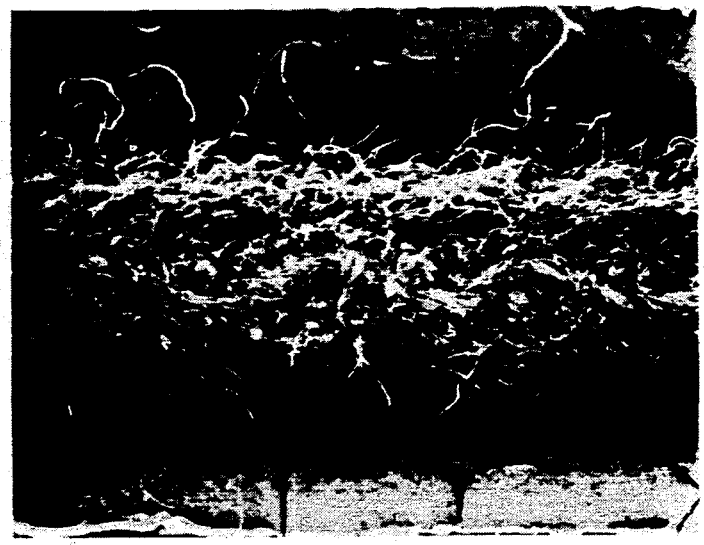
FIG. 45 is a scanning electron photomicrograph 14×) of a cross-section (extending in the warp direction) of the fabric of FIG. 43 (i.e., napped and treated as set forth in Example 7), with the napped and treated face top-most.

The fabric after treatment is depicted in FIGS. 43 through 45. Comparing FIGS. 40 and 43, it may be seen that the hatched area to the left of the solid block appears to have an overall lighter color in FIG. 43 than the corresponding area in FIG. 40, and the hatched area below the solid block of FIG. 43 appears significantly darker in color than the corresponding area in FIG. 40, indicating that the light colored warp yarns have been acted upon to a significant degree. This conclusion is confirmed in FIG. 44, which clearly indicates a substantial degree of fiber raising on the warp yarn, especially when compared with the warp yarn prior to treatment, as shown in the upper portion of FIG. 41. It should also be noted that the pre- and post-treatment fill yarns depicted in the lower portions of FIGS. 41 and 44, respectively, appear to have substantially the same degree of fiber raising, indicating that the fluid jet treatment did not significantly increase the degree of fiber raising among the fill yarns.

Figure 42:
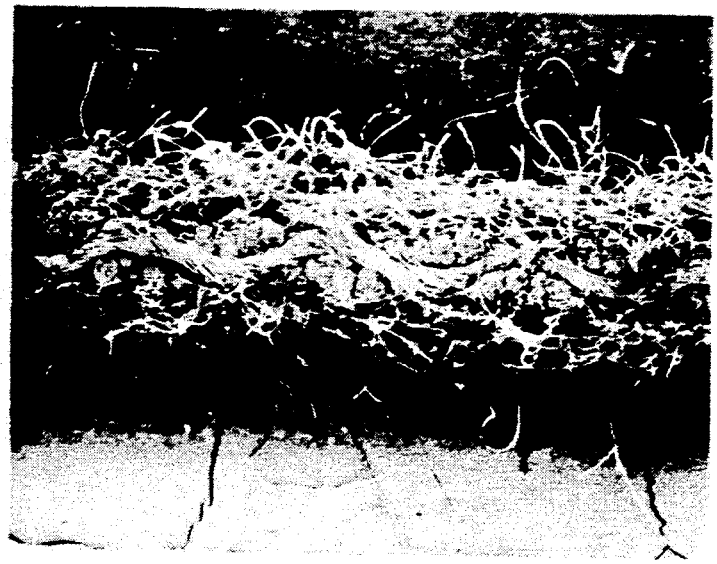
FIG. 42 is a scanning electron photomicrograph (14×) of a cross-section (extending in the warp direction) of the fabric of FIG. 40 (i.e., moderately napped in a conventional manner), with the napped face top-most.

FIG. 45, when compared with FIG. 42, indicates in cross-section the degree of fiber raising, and the relative uniformity of such pile raising, which is achieved by the fluid treatment of this Example (FIG. 45) over the starting material (FIG. 42).

Figure 46:
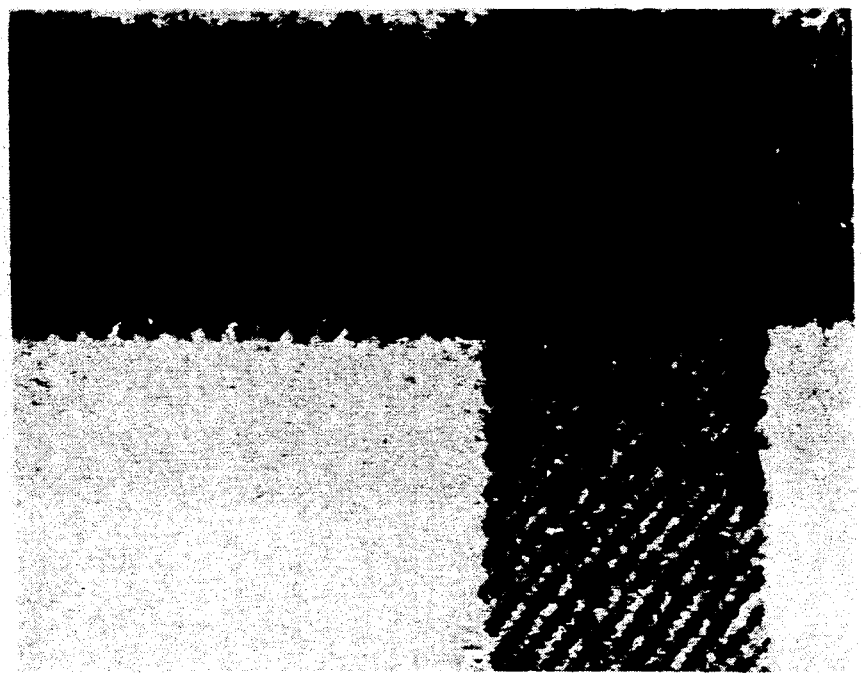
FIG. 46 is a reflected light photomicrograph (1.9×) of the fabric of FIG. 40 which has been extensively napped in a conventional manner in an effort to generate the comparable nap found in the fabric of FIG. 43.
Figure 47:
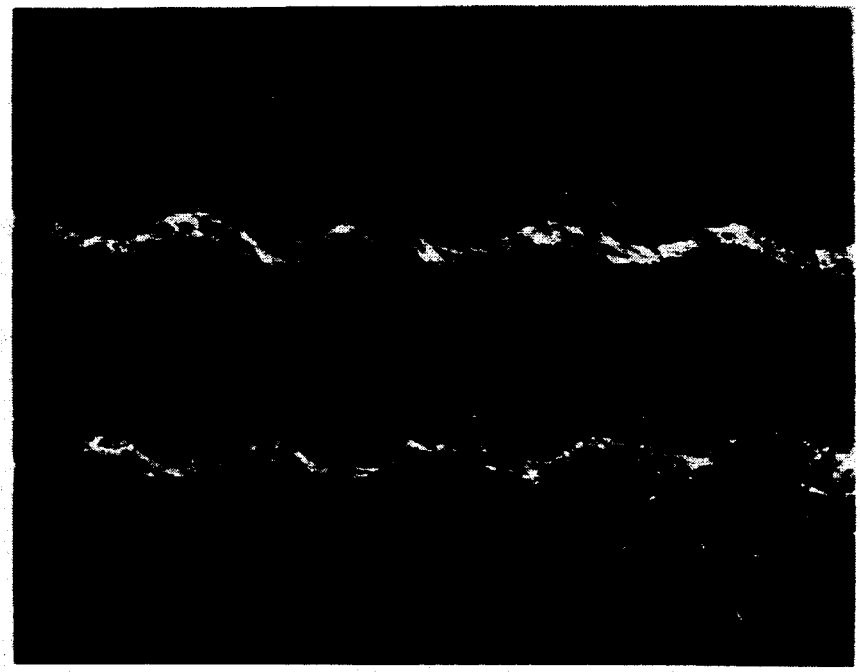
FIG. 47 is a reflected light photomicrograph (10×) of individual warp and fill yarns (upper and lower portions of the Figure, respectively) taken from the fabric of FIG. 46.
Figure 48:
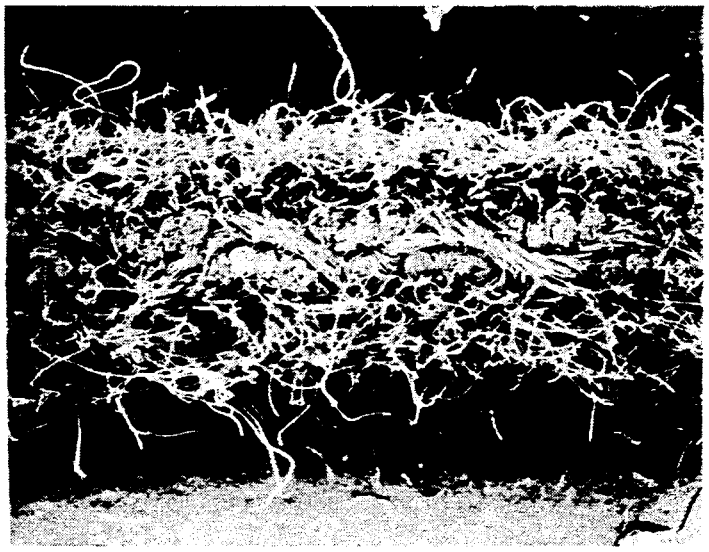
FIG. 48 is a scanning electron photomicrograph 14×) of a cross-section (extending in the warp direction) of the fabric of FIG. 46 (i.e., heavily napped in a conventional manner), with the napped face top-most.

For the sake of illustration, the pre-napped starting fabric was subjected to a second conventional napping operation in an effort to generate approximately the same degree of fiber raising achieved by the fluid jet treatment disclosed herein and shown in FIGS. 43 through 45, but by conventional means. The results are shown in FIGS. 46 through 48. It should be noted that the hatched area to the left of the solid pattern block of FIG. 46 is decidedly darker in appearance than the corresponding area of FIG. 43 and the hatched area below the solid pattern block of FIG. 46 is decidedly lighter in appearance than the corresponding area of FIG. 43, again indicating that conventional napping acts predominately on the darker fill yarns, rather than the lighter warp yarns. This conclusion is substantiated in FIG. 47, wherein the fill yarn shown in the lower portion of the Figure exhibits substantially more fiber raising than the warp yarn shown in the upper portion of the Figure. A comparison of the upper portions of FIGS. 44 and 47 clearly reveals the fluid jet treatment disclosed herein operates preferentially (but not exclusively) on the warp yarns of the subject fabric, rather than the fill yarns as in conventional wire napping techniques.

A comparison of FIGS. 45 and 48 also demonstrates, in cross-section, the uniformity and degree of pile raising achieved by the techniques of Example 7, when compared with conventional techniques.

As discussed previously, it is believed that the treatment specified herein tends to raise fibers on woven fabrics primarily from the warp yarns in such fabrics, rather than the fill yarns, and that this warp-yarn preference is significant for at least two reasons:

(1) conventional wire napping techniques have a contrary tendency, i.e., in such fabrics, the raised fibers, and therefore the loss of tensile strength, originate in the fill yarns rather than the warp yarns;

(2) using the treatment described herein, the inevitable loss of fabric strength due to fiber raising is limited to the warp direction, and may be compensated for by increasing the size of the yarns used in the warp direction without the attendant penalty in weaving efficiency which would normally accompany an increase in the size of the yarns used in the fill direction, and which therefore makes fill direction strength compensation relatively costly in terms of fabrication efficiency.

In an effort to quantify this direction-preferential relative strength reduction, ten individual darkly dyed yarns and ten individual lightly dyed yarns were taken from each of the warp and the fill directions of each of the fabrics of Figures 36, 38, 40, 43, and 46. As discussed earlier, these FIGS. correspond to (1) a control fabric, (2) a treated product (i.e., hydraulic napping only), (3) a conventionally and moderately napped ("pre-napped") product, (4) a conventionally and moderately napped product which is subsequently hydraulically napped in accordance with the teachings herein, and (5) a conventionally and more heavily napped product. It is important to note that the degree of fiber raising in the more heavily napped product was intended to be about equal to the degree of fiber raising in the lightly napped and treated product; however, in terms of the resulting look and feel of the finished products, the products of categories (4) and (5), as shown in FIGS. 40 and 46, respectively, were not considered equivalent due to the fact that the conventionally napped product began to show signs of extreme deterioration prior to achieving a subjectively equivalent degree of fiber raising.

Each of the selected yarns was subjected to tensile strength measurements, using a Model 1122 Instron testing machine and A.S.T.M. Method No. D2256, except that sample size required use of a two inch gauge length.

Figure 49:
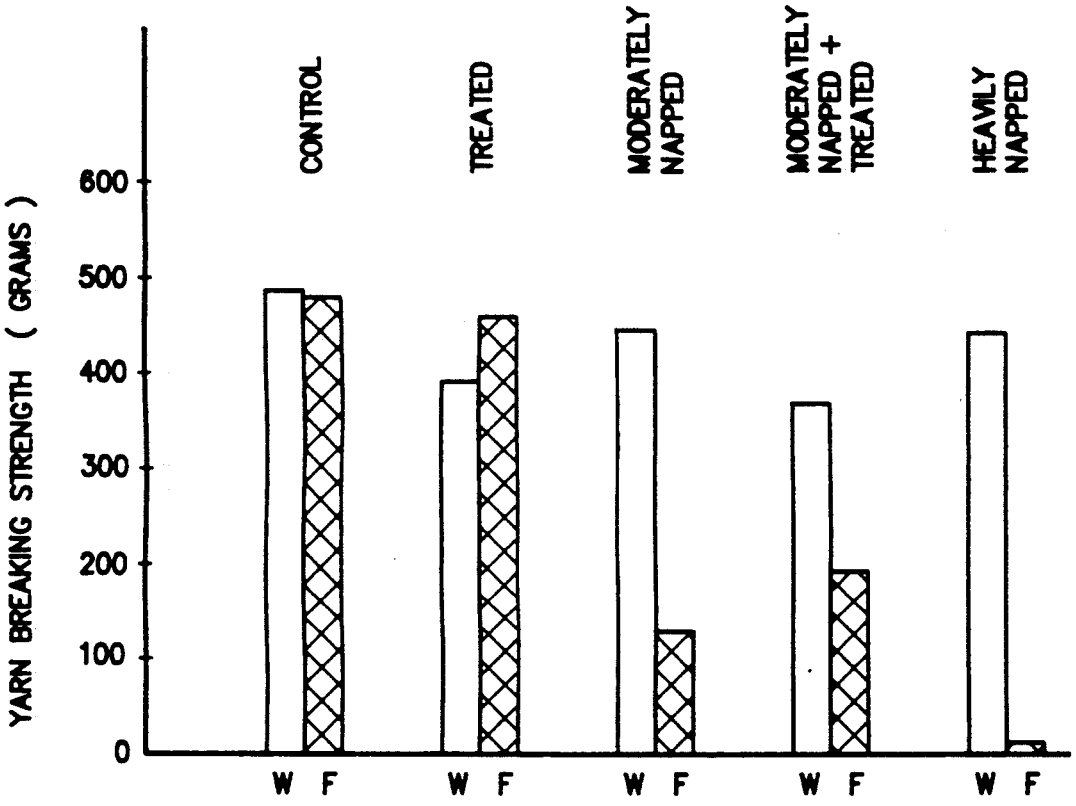
FIG. 49 is a histogram indicating the average results of representative tensile strength tests performed on the warp and fill yarns of the various fabrics of FIGS. 36, 38, 40, 43.

The statistically calculated mean values are set forth in Table 1, and are graphically depicted in the histogram of FIG. 49.

TABLE 1

| YARN TENSILE STRENGTH (GRAMS) | | |
|---|---|---|
| | WARP | FILL |
| Control Fabric | 478 | 473 |
| Treated Fabric | 385 | 454 |
| Conventionally Moderately Napped Fabric | 448 | 128 |
| Conventionally Moderately Napped + Treated Fabric | 368 | 195 |
| Conventionally Heavily Napped Fabric | 445 | 14 |

As can be seen, warp and fill yarn strength in the control fabric is substantially the same, but conventional napping (i.e., moderate napping or heavy napping) dramatically decreases the yarn breaking strength among fill yarns, while having relatively little effect among warp yarns. Indeed, the heavily napped fill yarns exhibit very little tensile strength.

By comparison, the treated yarns show insignificant reduction of fill yarn tensile strength, and only limited reduction of corresponding warp yarn strength. Even if, prior to treatment, the fabric is moderately napped (i.e., napped to about the same degree represented by the fabric of FIGS. 40 through 42), the resulting napped and treated product does not show the same degree of tensile strength loss in either the warp or fill direction as was shown in the heavily napped product of FIGS. 46 through 48. Surprisingly, the napped and treated product shows a dramatic improvement in the fill yarn strength over yarns taken from either the lightly napped or heavily napped products, i.e., treating appears to increase fill yarn strength. This effect is believed due to the fiber entanglement which is induced by the hydraulic napping process of the invention. It should be noted in assessing the results shown in FIG. 49 that a comparison between the moderately napped fabric and the moderately napped and treated fabric shows the latter to have a much denser, more uniform pile, and substantially increased bulk, without the attendant loss in fill strength associated with conventionally napped products.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

We claim:

1. A method for patterning a textile fabric, said fabric being comprised of substantially continuous yarns which are interlaced in a repeating configuration and having an left outer lateral edge, an right outer lateral edge, and a point therebetween, said method comprising:

a. placing said fabric against a support member;

b. directing at least one fluid stream perpendicular to the surface of said fabric at said point;

c. directing a plurality of fluid streams towards the surface of said fabric, said streams monotonically deviating from each other leftward from said point until achieving a first angle of deviation from said streams striking said point to said streams striking said left outer lateral edge of the fabric wherein said first angle of deviation is greater than zero and less then thirty-five degrees and said streams monotonically deviating from each other rightward from said point until achieving a second angle of deviation from said streams striking said point to said streams striking said right outer lateral edge of the fabric wherein said second angle of deviation is greater than zero and less then thirty-five degrees; and d. delivering each of said streams at a peak dynamic pressure in excess of about 75 p.s.i.g.

2. The method of claim 1, wherein said fluid is water.

3. The method of claim 2, wherein said support member provides a smooth, impenetrable surface.

4. A method for patterning a textile fabric, said fabric being comprised of substantially continuous yarns which are interlaced in a repeating configuration and having a left portion with a left outer lateral edge, right portion with a right outer lateral edge, middle portion with a right outer lateral edge and a left outer lateral edge and a point therebetween, said method comprising:

a. placing said fabric against a support member;

b. directing at least one fluid stream perpendicular to the surface of said fabric at said point between said right outer lateral edge and said left outer lateral edge;

c. directing a plurality of fluid streams towards the surface of said fabric, said streams monotonically deviating from each other leftward from said point until achieving a first angle of deviation from said streams striking said point to said streams striking said left outer lateral edge of said middle portion wherein said first angle of deviation is greater than zero and less then thirty-five degrees and maintaining said first angle of deviation leftward throughout said left portion until said left outer lateral edge and said stream monotonically deviating from each other rightward from said point until achieving a second angle of deviation from said streams striking said point to said streams striking said right outer lateral edge of said middle portion wherein said second angle of deviation is greater than zero and less then thirty-five degrees and maintaining said second angle of deviation rightward throughout said right portion until said right outer lateral edge; and d. delivering each of said streams at a peak dynamic pressure in excess of about 75 p.s.i.g.

5. The method of claim 4, wherein said fluid is water.

6. The method of claim 4, wherein said support member provides a smooth, impenetrable surface.

7. An apparatus for patterning a textile fabric comprising:

a. a support member having a longitudinal axis, left portion with a left outer lateral edge, right portion with a right outer lateral edge, and a point therebetween; and b. a plurality of fluid jets mounted on said support member wherein at least one of said fluid jets are directed perpendicular to said longitudinal axis at said point and said fluid jets monotonically deviate from a line perpendicular to said longitudinal axis on said right portion rightward until deviation is at a first angle at said right outer lateral edge of said right portion wherein said first angle of deviation is greater than zero and less then thirty-five degrees and monotonically deviate from a line perpendicular to said longitudinal axis on said left portion leftward until deviation is at a second angle at said left outer lateral edge of said left portion wherein said second angle of deviation is greater than zero and less then thirty-five degrees.

8. The apparatus of claim 7, wherein said first angle is between zero and twenty-five degrees and said second angle is between zero and twenty-five degrees.

9. The apparatus of claim 7, wherein said first angle is between zero and fifteen degrees and said second angle is between zero and fifteen degrees.

10. The apparatus of claim 7, wherein said first angle is between zero and ten degrees and said second angle is between zero and ten degrees.

11. The apparatus of claim 7, wherein said first angle is between zero and five degrees and said second angle is between zero and five degrees.

12. An apparatus for patterning a textile fabric comprising:

a. a support member having a longitudinal axis and a right portion with a right outer lateral edge, a left portion with a left outer lateral edge, middle portion having a right outer lateral edge and a left outer lateral edge and a point therebetween; and b. a plurality of fluid jets mounted on said support member wherein each fluid jet on said right portion is directed at a first angle rightward of a line perpendicular to said longitudinal axis of said support member toward said right outer lateral edge and each fluid jet on said left portion directed at a second angle leftward of a line perpendicular to said longitudinal axis of said support member toward said left outer lateral edge and at least one of said fluid jets in said middle portion are directed perpendicular to said longitudinal axis of said support member at said point and said fluid jets monotonically deviate from a line perpendicular to said longitudinal axis rightward of said point until deviation is at said first angle at said right outer lateral edge of said middle portion and monotonically deviate from a line perpendicular to said longitudinal axis leftward of said point until deviation is at said second angle at said left outer lateral edge of said middle portion wherein said first angle of deviation is greater than zero and less than thirty-five degrees and said second angle of deviation is greater than zero and less than thirty five degrees.

13. The apparatus of claim 12, wherein said first angle is between zero and twenty-five degrees and said second angle is between zero and twenty-five degrees.

14. The apparatus of claim 12, wherein said first angle is between zero and fifteen degrees and said second angle is between zero and fifteen degrees.

15. The apparatus of claim 12, wherein said first angle is between zero and ten degrees and said second angle is between zero and ten degrees.

16. The apparatus of claim 12, wherein said first angle is between zero and five degrees and said second angle is between zero and five degrees.

17. The apparatus of claim 12, wherein said fluid jets are water jets.

18. A method for patterning a textile fabric, said fabric being comprised of substantially continuous yarns which are interlaced in a repeating configuration and having an left outer lateral edge, an right outer lateral edge, and a point therebetween, said method comprising:

a. placing said fabric against a support member;
b. directing at least one fluid stream perpendicular to the surface of said fabric at said point;
c. directing a plurality of fluid streams towards the surface of said fabric, said streams monotonically deviating from each other leftward from said point until achieving a first angle of deviation from said streams striking said point to said streams striking said left outer lateral edge of the fabric wherein said first angle of deviation is greater than zero and less then twenty-five degrees and said streams monotonically deviating from each other rightward from said point until achieving a second angle of deviation from said streams striking said point to said streams striking said right outer lateral edge of the fabric wherein said second angle of deviation is greater than zero and less then twenty-five degrees; and
d. delivering each of said streams at a peak dynamic pressure in excess of about 75 p.s.i.g.

19. A method for patterning a textile fabric, said fabric being comprised of substantially continuous yarns which are interlaced in a repeating configuration and having an left outer lateral edge, an right outer lateral edge, and a point therebetween, said method comprising:

a. placing said fabric against a support member;
b. directing at least one fluid stream perpendicular to the surface of said fabric at said point;
c. directing a plurality of fluid streams towards the surface of said fabric, said streams monotonically deviating from each other leftward from said point until achieving a first angle of deviation from said streams striking said point to said streams striking said left outer lateral edge of the fabric wherein said first angle of deviation is greater than zero and less then fifteen degrees and said streams monotonically deviating from each other rightward from said point until achieving a second angle of deviation from said streams striking said point to said streams striking said right outer lateral edge of the fabric wherein said second angle of deviation is greater than zero and less then fifteen degrees; and
d. delivering each of said streams at a peak dynamic pressure in excess of about 75 p.s.i.g.

20. A method for patterning a textile fabric, said fabric being comprised of substantially continuous yarns which are interlaced in a repeating configuration and having an left outer lateral edge, an right outer lateral edge, and a point therebetween, said method comprising:

a. placing said fabric against a support member;
b. directing at least one fluid stream perpendicular to the surface of said fabric at said point;
c. directing a plurality of fluid streams towards the surface of said fabric, said streams monotonically deviating from each other leftward from said point until achieving a first angle of deviation from said streams striking said point to said streams striking said left outer lateral edge of the fabric wherein said first angle of deviation is greater than zero and less then ten degrees and said streams monotonically deviating from each other rightward from said point until achieving a second angle of deviation from said streams striking said point to said streams striking said right outer lateral edge of the fabric wherein said second angle of deviation is greater than zero and less then ten degrees; and
d. delivering each of said streams at a peak dynamic pressure in excess of about 75 p.s.i.g.

21. A method for patterning a textile fabric, said fabric being comprised of substantially continuous yarns which are interlaced in a repeating configuration and having an left outer lateral edge, an right outer lateral edge, and a point therebetween, said method comprising:

a. placing said fabric against a support member;
b. directing at least one fluid stream perpendicular to the surface of said fabric at said point;
c. directing a plurality of fluid streams towards the surface of said fabric, said streams monotonically deviating from each other leftward from said point until achieving a first angle of deviation from said streams striking said point to said streams striking said left outer lateral edge of the fabric wherein said first angle of deviation is greater than zero and less then five degrees and said streams monotonically deviating from each other rightward from said point until achieving a second angle of deviation from said streams striking said point to said streams striking said right outer lateral edge of the fabric wherein said second angle of deviation is greater than zero and less then five degrees; and
d. delivering each of said streams at a peak dynamic pressure in excess of about 75 p.s.i.g.

22. A method for patterning a textile fabric, said fabric being comprised of substantially continuous yarns which are interlaced in a repeating configuration and having a left portion with a left outer lateral edge, right portion with a right outer lateral edge, middle portion with a right outer lateral edge and a left outer lateral edge and a point therebetween, said method comprising:

a. placing said fabric against a support member;

b. directing at least one fluid stream perpendicular to the surface of said fabric at said point between said right outer lateral edge and said left outer lateral edge;

c. directing a plurality of fluid streams toward the surface of said fabric, said streams monotonically deviating from each other leftward from said point until achieving a first angle of deviation from said streams striking said point to said streams striking said left outer lateral edge of said middle portion wherein said first angle of deviation is greater than zero and less then twenty-five degrees and maintaining said first angle of deviation leftward throughout said left portion until said left outer lateral edge and said stream monotonically deviating from each other rightward from said point until achieving a second angle of deviation from said streams striking said point to said streams striking said right outer lateral edge of said middle portion wherein said second angle of deviation is greater than zero and less then twenty-five degrees and maintaining said second angle of deviation rightward throughout said right portion until said right outer lateral edge; and d. delivering each of said streams at a peak dynamic pressure in excess of about 75 p.s.i.g.

23. A method for patterning a textile fabric, said fabric being comprised of substantially continuous yarns which are interlaced in a repeating configuration and having a left portion with a left outer lateral edge, right portion with a right outer lateral edge, middle portion with a right outer lateral edge and a left outer lateral edge and a point therebetween, said method comprising:

a. placing said fabric against a support member;

b. directing at least one fluid stream perpendicular to the surface of said fabric at said point between said right outer lateral edge and said left outer lateral edge;

c. directing a plurality of fluid streams toward the surface of said fabric, said streams monotonically deviating from each other leftward from said point until achieving a first angle of deviation from said streams striking said point to said streams striking said left outer lateral edge of said middle portion wherein said first angle of deviation is greater than zero and less then fifteen degrees and maintaining said first angle of deviation leftward throughout said left portion until said left outer lateral edge and said stream monotonically deviating from each other rightward from said point until achieving a second angle of deviation from said streams striking said point to said streams striking said right outer lateral edge of said middle portion wherein said second angle of deviation is greater than zero and less then fifteen degrees and maintaining said second angle of deviation rightward throughout said right portion until said right outer lateral edge; and d. delivering each of said streams at a peak dynamic pressure in excess of about 75 p.s.i.g.

24. A method for patterning a textile fabric, said fabric being comprised of substantially continuous yarns which are interlaced in a repeating configuration and having a left portion with a left outer lateral edge, right portion with a right outer lateral edge, middle portion with a right outer lateral edge and a left outer lateral edge and a point therebetween, said method comprising:

a. placing said fabric against a support member;

b. directing at least one fluid stream perpendicular to the surface of said fabric at said point between said right outer lateral edge and said left outer lateral edge;

c. directing a plurality of fluid streams toward the surface of said fabric, said streams monotonically deviating from each other leftward from said point until achieving a first angle of deviation from said streams striking said point to said streams striking said left outer lateral edge of said middle portion wherein said first angle of deviation is greater than zero and less then ten degrees and maintaining said first angle of deviation leftward throughout said left portion until said left outer lateral edge and said stream monotonically deviating from each other rightward from said point until achieving a second angle of deviation from said streams striking said point to said streams striking said right outer lateral edge of said middle portion wherein said second angle of deviation is greater than zero and less then ten degrees and maintaining said second angle of deviation rightward throughout said right portion until said right outer lateral edge; and d. delivering each of said streams at a peak dynamic pressure in excess of about 75 p.s.i.g.

25. A method for patterning a textile fabric, said fabric being comprised of substantially continuous yarns which are interlaced in a repeating configuration and having a left portion with a left outer lateral edge, right portion with a right outer lateral edge, middle portion with a right outer lateral edge and a left outer lateral edge and a point therebetween, said method comprising:

a. placing said fabric against a support member;

b. directing at least one fluid stream perpendicular to the surface of said fabric at said point between said right outer lateral edge and said left outer lateral edge;

c. directing a plurality of fluid streams toward the surface of said fabric, said streams monotonically deviating from each other leftward from said point until achieving a first angle of deviation from said streams striking said point to said streams striking said left outer lateral edge of said middle portion wherein said first angle of deviation is greater than zero and less then five degrees and maintaining said first angle of deviation leftward throughout said left portion until said left outer lateral edge and said stream monotonically deviating from each other rightward from said point until achieving a second angle of deviation from said streams striking said point to said streams striking said right outer lateral edge of said middle portion wherein said second angle of deviation is greater than zero and less then five degrees and maintaining said second angle of deviation rightward throughout said right portion until said right outer lateral edge; and d. delivering each of said streams at a peak dynamic pressure in excess of about 75 p.s.i.g.

* * * * *